US005835457A

United States Patent [19]

Nakajima

[11] Patent Number: 5,835,457

[45] Date of Patent: Nov. 10, 1998

[54] ELECTRONIC WATCH AND METHOD OF CHARGING THE SAME

[75] Inventor: Fumio Nakajima, Tokyo, Japan

[73] Assignee: Citizen Watch Co., Ltd., Tokyo, Japan

[21] Appl. No.: 778,777

[22] Filed: Jan. 6, 1997

[51] Int. Cl.[6] ..... G04B 1/00; G04C 3/00

[52] U.S. Cl. ..... 368/204; 368/205

[58] Field of Search ..... 368/205, 204, 368/203

[56] References Cited

U.S. PATENT DOCUMENTS

| | | | |
|---|---|---|---|
| 4,730,287 | 3/1988 | Yoshino et al. | 368/205 |
| 4,785,435 | 11/1988 | Inoue et al. | 368/205 |

FOREIGN PATENT DOCUMENTS

| | | | |
|---|---|---|---|
| 4-81754 | 12/1992 | Japan . | |
| 2158274 | 11/1985 | United Kingdom | 368/205 |

*Primary Examiner*—Bernard Roskoski
*Attorney, Agent, or Firm*—Armstrong, Westerman, Hattori, McLeland, & Naughton

[57] ABSTRACT

The electronic watch according to the invention comprises an energy source 1 (power supply), storage circuit 3, clock output unit 4, constant voltage circuit 5, voltage detection circuit 6, switching circuit 8, and control unit. The energy source 1 transforms external energy into electric energy and supplies a power supply voltage. The storage circuits 3 stores the power supply voltage or a booster voltage of the power supply voltage and thereby supplies a storage voltage. The clock output unit has a watch system and a condenser of a small capacitance, receives any of the power supply voltage or the booster voltage, and the storage voltage, and supplies a plurality of logic signals. The constant voltage circuit 5 generates a reference voltage from the clock voltage. The voltage detection circuit 6 compares the power supply voltage or booster voltage, storage voltage, and clock voltage selectively with a voltage set on the basis of the reference voltage and supplies a voltage detection signal. The switch circuit 8 is provided with a plurality of switches for controlling charging times of the storage circuit and the clock output unit. The control unit controls the switching circuit 8 by a plurality of pulse width variable switch control signals corresponding to a plurality of the logic signals and the voltage detection signal.

22 Claims, 11 Drawing Sheets

ELECTRONIC WATCH AND METHOD OF CHARGING THE SAME

BACKGROUND OF THE INVENTION

1. Field of the Invention

The present invention relates to an electronic watch which employs an energy source such as an electrothermic generator or solar battery producing electric energy using external energy as a power supply and has a storage means for storing electric power generated by the energy source, and the method of charging the same.

2. Description of the Prior Art

There is a conventional electronic watch having a storage means for storing electric power produced by such an energy source, which is, for example, disclosed in the Japanese Patent Publication JP-B-4-81754.

FIGS. 11 to 13 show charging circuits for the conventional electronic watch which are disclosed in the publication JP-B-4-81754. FIGS. 14 and 15 illustrate waveforms of control signals of the conventional charging circuits.

FIG. 14 illustrates waveforms of signals generated when the condenser C1 and C2 of the charging circuits shown in FIGS. 11 to 13 are alternately charged synchronously with the drive signal. FIG. 15 illustrates waveforms of signals when the condenser C1 is charged continuously for double periods of the drive signal by increasing the capacitance value of the condenser C2 a little.

First, the construction of the charging circuits shown in FIGS. 11 to 13 will be described.

The charging circuit of the electronic watch comprises a power supply SC using a solar battery as an energy source, a condenser C1 with a large capacitance as the storage means such as a double layer condenser, a condenser C2 with a small capacitance connected in parallel to a clock circuit (not illustrated) connected across the terminal a-b, a switch SW1 to connect the condenser C1 and C2 in parallel, a switch SW2 to connect the condenser C1 and the power supply SC in series, a backflow preventer diode D1 interposed so as to form a closed circuit together with the power supply SC and the condenser C1 and the switch SW2, and a backflow preventer diode D2 interposed so as to form a closed circuit together with the power supply SC and the condenser C2.

The clock circuit not illustrated comprises a voltage detection circuit for detecting charged voltages across the condenser C1 and C2 and a control circuit for controlling the switch SW1 and SW2.

Next, the operation of the charging circuit will be described with reference to the waveforms shown in FIGS. 14 and 15.

FIGS. 14 and 15 each illustrate a drive signal for driving a step motor to advance a display mechanism of the watch one step for each second, a detection control signal for controlling the voltage detection circuit for detecting the charged voltages across the condensers C1 and C2 synchronously with the drive signal, a detection signal of the charged voltage across the condenser C2 by the voltage detection circuit, a SW1 control signal for controlling the switch SW1, and a SW2 control signal for controlling the switch SW2.

At an initial condition of this charging circuit, the switch SW1 and SW2 are both open-circuit as shown in FIG. 11, and there are no voltages charged across the condenser C1 and C2.

Here, if light falls on the solar cells of the power supply SC, it will be transformed into electric power, and the power supply SC and the condenser C2 and the diode D2 will form a closed circuit, whereby the condenser C2 with a small capacitance will be charged through the diode D2 by the power supply SC.

When the condenser C2 is charged to a specific voltage or more, the clock circuit connected across the terminal a-b and the voltage detection circuit equipped in the clock circuit and the control circuit for controlling the switch SW1 and SW2 start operation.

If the condenser C2 is charged up to 2 volts or more, for example, the voltage detection circuit will detect the voltage and generate a detection signal, and the control circuit will close the switch SW2, thus forming a state shown in FIG. 12.

The operation represented by the waveforms shown in FIG. 14 will now be described. If the voltage charged across the condenser C2 is 2 volts or more at the time that a drive signal P1 is generated, the detection signal will be generated, and the SW2 control signal will turn into High level (hereinafter, simply mentioned as "H") at the time t1 to close the switch SW2. Thereby, the condenser C1 with a large capacitance that has not been charged starts being charged.

Thereafter, if the voltage charged across the condenser C2 is 2 volts or less at the time that a drive signal P2 is generated, the detection signal will not be generated, and the SW2 control signal will turn into Low level (hereinafter, simply mentioned as "L") at the time t2 to open the switch SW2, and the circuit will be returned to the state shown in FIG. 11. Between the time t1 and t2, the condenser C1 is mainly charged and the clock circuit is supplied with the electric power charged across the condenser C2.

Next, if the voltage charged across the condenser C2 is 2 volts or more at the time that a drive signal P3 is generated, the detection signal will be generated, the SW2 control signal will turn into "H" to close the switch SW2, and again the circuit will be returned into the state shown in FIG. 12. Between the time t2 and t3, only the condenser C2 is charged and from the time t3 the condenser C1 is charged again. In this manner, the condenser C1 and C2 are charged alternately for every one second, namely, the period in which the drive signal is generated. During the period, the SW1 control signal is held "L" and the switch SW1 is kept open.

If the voltage charged across the condenser C1 with a large capacitance is 2 volts or more, the voltage detection circuit will detect the voltage, both the SW1 and SW2 control signals will turn into "H", and the control circuit closes both the switches SW1 and SW2, thereby forming a state shown in FIG. 13. At that time, the condenser C1 and C2 are connected in parallel to be charged simultaneously. The clock circuit is supplied with the electric power charged across the condenser C1 and C2, and the circuit goes into a normal operation.

In an operation represented by the waveforms shown in FIG. 15, at the time that the drive signal P1 is generated, the voltage charged across the condenser C2 is 2 volts or less and the detection signal is not generated, the SW2 control signal turns into "L" at the time t1 to open the switch SW2, and the circuit is put into the state in FIG. 11. Therefore, the condenser C2 is charged from the time t1.

Thereafter, if the detected voltage from the condenser C2 is 2 volts or more at the time that the drive signal P2 is generated, the detection signal will be generated and the SW2 control signal will turn into "H" at the time t2 to close the switch SW2, and the circuit will be put into the state in FIG. 12. Between the time t1 and t2 the condenser C2 is charged, and from the time t2 the condenser C1 is charged.

Furthermore, if the voltage charged across the condenser C2 is still maintained at 2 volts or more at the time that the drive signal P3 is generated, the detection signal will be generated again, and the SW2 control signal will be maintained at "H"; and therefore, the switch SW2 will be kept closed at the time t3 and after and the state in FIG. 12 will be continued. Therefore, the condenser C1 is continuously charged at the time t3 and after.

Still, if the detected voltage from the condenser C2 is 2 volts or less at the time that a drive signal P4 is generated, the detection signal will not be generated, the SW2 control signal will turn into "L" at the time t4 to open the switch SW2, and the circuit will be returned to the state in FIG. 11. Therefore, the condenser C2 is charged again from the time t4. During that time, the SW1 control signal is kept at "L" and the switch SW1 is kept open.

Further, if the voltage charged across the condenser C1 is 2 volts or more, the voltage detection circuit will detect the voltage, both the SW1 and SW2 control signal will turn into "H", the control circuit will close both switches SW1 and SW2, and the circuit will be returned to the state in FIG. 13. At that time, the condenser C1 and C2 are connected in parallel to be charged synchronously.

However, in the foregoing conventional charging circuit, if the capacitance of the condenser C2 is set to a small one, the condenser C1 with a large capacitance and the condenser C2 with a small capacitance will be charged alternately for every one second, i.e., the period when the drive signal is generated as shown in FIG. 14, and therefore, condenser C1 with a large capacitance as the main storage means can be charged with up to only half of the electric energy that the solar cells of the power supply SC generates.

Furthermore, in order that the electric power charged across the condenser C2 for one second from the time t2 to t3 in FIG. 14 can supply the power to drive the pulse motor for the period of the two drive signals P3, P4, it is necessary to increase the capacitance of the condenser C2 to some extent. If the capacitance is increased, it will elongate a duration from a time that the condenser C2 starts being charged to a time that the power supply voltage for the clock circuit reaches the minimum operational voltage, which deteriorates the self start-up performance of a watch.

Furthermore, as shown in FIG. 15, increasing a time for charging the large capacitance condenser C1 as the main storage means will require to further increase the capacitance of the condenser C2, because the condenser C2 has to store the power to drive the pulse motor for the period of the three drive signals P2, P3 and P4. To increase the capacitance of the condenser C2 further elongates a duration from a time that the condenser C2 starts being charged to a time that the clock circuit reaches the minimum operational voltage.

Still more, there are the backflow preventer diodes D1, D2 always interposed in the circuit, and power losses by the backflow preventer diodes D1 and D2 cannot be ignored when a power generated by the power supply SC is low.

SUMMARY OF THE INVENTION

The present invention has been made in view of the foregoing problems of an electronic watch having such an energy source and a storage means for storing a power generated thereby, and it is an object of the present invention to provide a circuit for the electronic watch, whereby the storage means can be charged effectively and the power loss by the backflow preventer diode does not occur after the clock circuit starts, even if the capacitance of the condenser connected in parallel to the clock circuit is decreased to raise the self start-up performance.

The electronic watch according to the invention comprises an energy source (power supply), storage circuit, clock output unit, constant voltage circuit, voltage detection circuit, switching circuit, and control unit. The energy source transforms external energy into electric energy and supplies a power supply voltage. The storage circuits stores the power supply voltage or a booster voltage of the power supply voltage and thereby supplies a storage voltage. The clock output unit has a watch system and a condenser of a small capacitance, receives any of the power supply voltage or the booster voltage, and the storage voltage, and supplies a plurality of logic signals. The constant voltage circuit generates a reference voltage from the clock voltage. The voltage detection circuit compares the power supply voltage or booster voltage, storage voltage, and clock voltage selectively with a voltage set on the basis of the reference voltage and supplies a voltage detection signal. The switch circuit is provided with a plurality of switches for controlling charging times of the storage circuit and the clock output unit. The control unit controls the switching circuit by a plurality of pulse width variable switch control signals corresponding to a plurality of the logic signals and the voltage detection signal.

A method of charging the electronic watch according to the invention the clock output means supplies a plurality of the logic signals, when the power supply voltage generated by the energy source becomes a specific level of voltage.

By means of the logic signals, the control means supplies a plurality of selection signals and data signals to the voltage detection circuit.

The voltage detection circuit selects any one of the power supply voltage, the booster voltage, the storage voltage, and the clock voltage corresponding to the selection signals, compares the selected voltage with a voltage set on the basis of the data signals and the reference voltage, and supplies the voltage detection signal corresponding to the magnitude of the voltages.

The control means supplies a plurality of switch control signals to the switching means corresponding to the voltage detection signal and the logic control signals.

By means of a plurality of the switch control signals, the switching means switches a plurality of the switches ON/OFF to control the charging times of the storage means and the clock output means to have the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

The above and other objects, features and advantages of the invention will be apparent from the following detailed description which is to be read in conjunction with the accompanying drawings.

DETAILED DESCRIPTION OF THE PREFERRED EMBODIMENTS

Preferred embodiments of the present invention will hereafter be described in detail with reference to the accompanying drawings.

Figure 1:
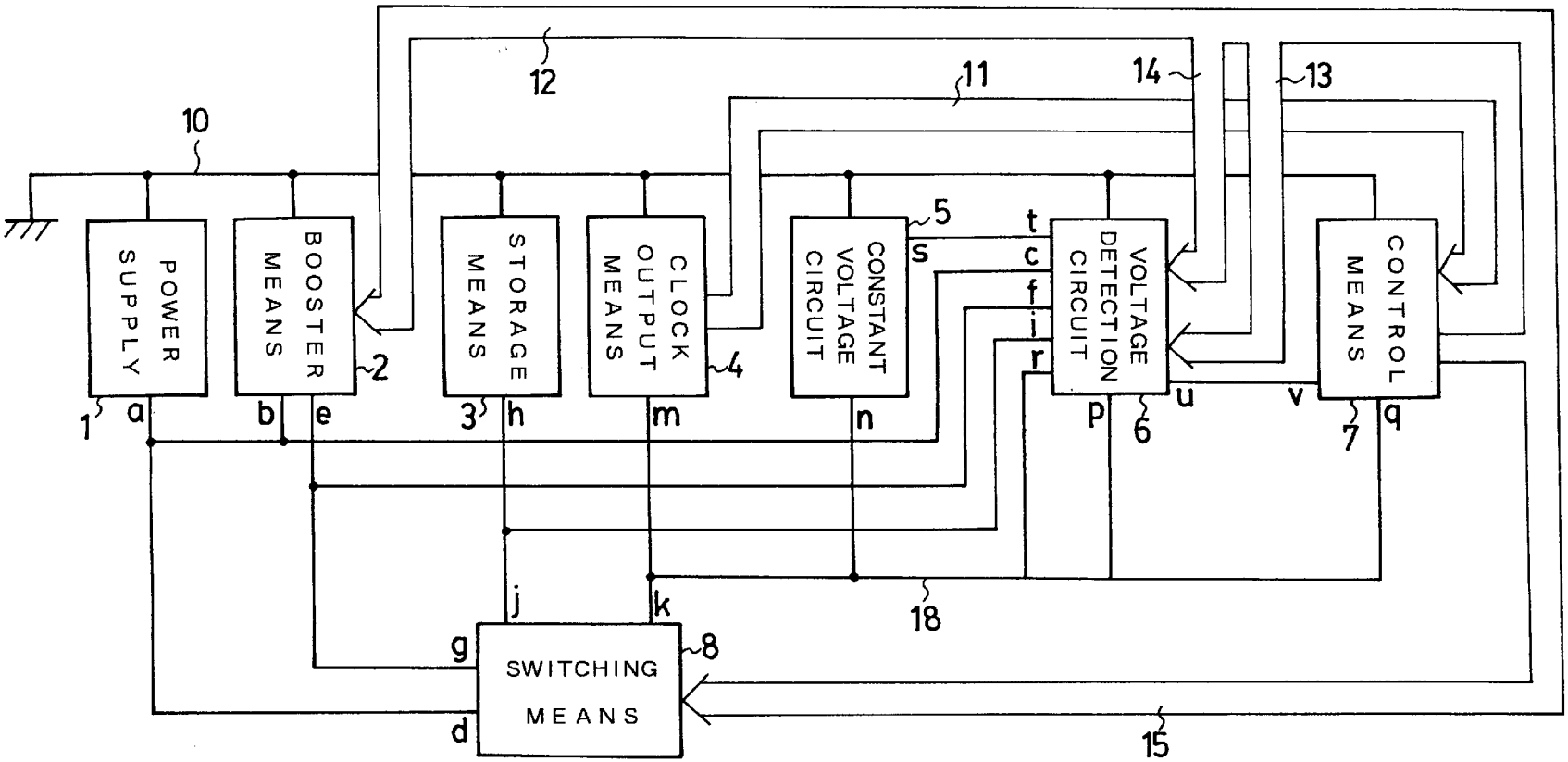
FIG. 1 is a block diagram showing a circuit construction of an electronic watch in an embodiment according to the present invention.

FIG. 1 is a block diagram showing a circuit construction of an electronic watch in an embodiment according to the present invention.

The electronic watch shown in FIG. 1 comprises a power supply 1 as an energy source, booster means 2, storage means 3, clock output means 4, constant voltage circuit 5, voltage detection circuit 6, control means 7, and switching means 8.

The higher potential side of the power supply 1 is the ground, and a ground line 10 connects the booster means 2, storage means 3, clock output means 4, constant voltage circuit 5, voltage detection circuit 6, and control means 7 on each of the higher potential sides of the power supply terminals.

The lower potential side of the power supply 1 is a power supply output terminal a from which the generated voltage is distributed, which is connected to a power supply input terminal b, c, and d of the booster means 2, voltage detection circuit 6, and switching means 8, respectively.

A booster voltage output terminal e of the booster means 2 is connected to a booster voltage input terminal f and g respectively of the voltage detection circuit 6 and the switching means 8. A storage voltage output terminal h of the storage means 3 is connected to a storage voltage input terminal i and j respectively of the voltage detection circuit 6 and the switching means 8.

Furthermore, a voltage output terminal k of the switch means 8 is connected respectively to a clock voltage terminal m of the clock output means 4, a voltage input terminal n, p, and q of the constant voltage circuit 5, voltage detection circuit 6, and the control circuit 7, and a clock voltage detection terminal r of the voltage detection circuit 6.

Still, a reference voltage output terminal s of the constant voltage circuit 5 is connected to a reference voltage input terminal t of the voltage detection circuit 6. A voltage detection signal output terminal u of the voltage detection circuit 6 is connected to a voltage detection signal input terminal v of the control means 7.

Still more, a logic signal bus 11 of the clock output means 4 is connected to the control means 7. A booster control signal bus 12 of the control means 7 is connected to the booster means 2, a data signal bus 13 and a selection signal bus 14 are connected to the voltage detection circuit 6, a switch control signal bus 15 is connected to the switching means 8.

The power supply 1 employed in this embodiment is, for example, an electrothermic generator based on the Seebeck effect. The electrothermic generator, although not illustrated, is made of a module in which thermoelectric element pairs with a P-type semiconductor substance and a N-type semiconductor substance coupled in series are assembled in multiple numbers.

The electrothermic generator generates a thermoelectromotive force when a temperature difference is given between both ends of a thermoelectric element pair, namely, the one end served as a hot pole and the other end served as a cold pole. In order to use the electrothermic generator as a power supply for a wrist watch, the inside of the watch is constructed such that the hot pole is placed on the rear side coming into contact with human skin and the cold pole is placed on the front side facing the air.

The power supply 1 is not limited to the electrothermic generator, but a solar battery or an electromechanical generator that transforms mechanical movement by body movement into electric energy may be used, as long as it generates electric energy by external energy. Since a comparably high voltage is generated, the booster means 2 may be omitted.

Figure 2:
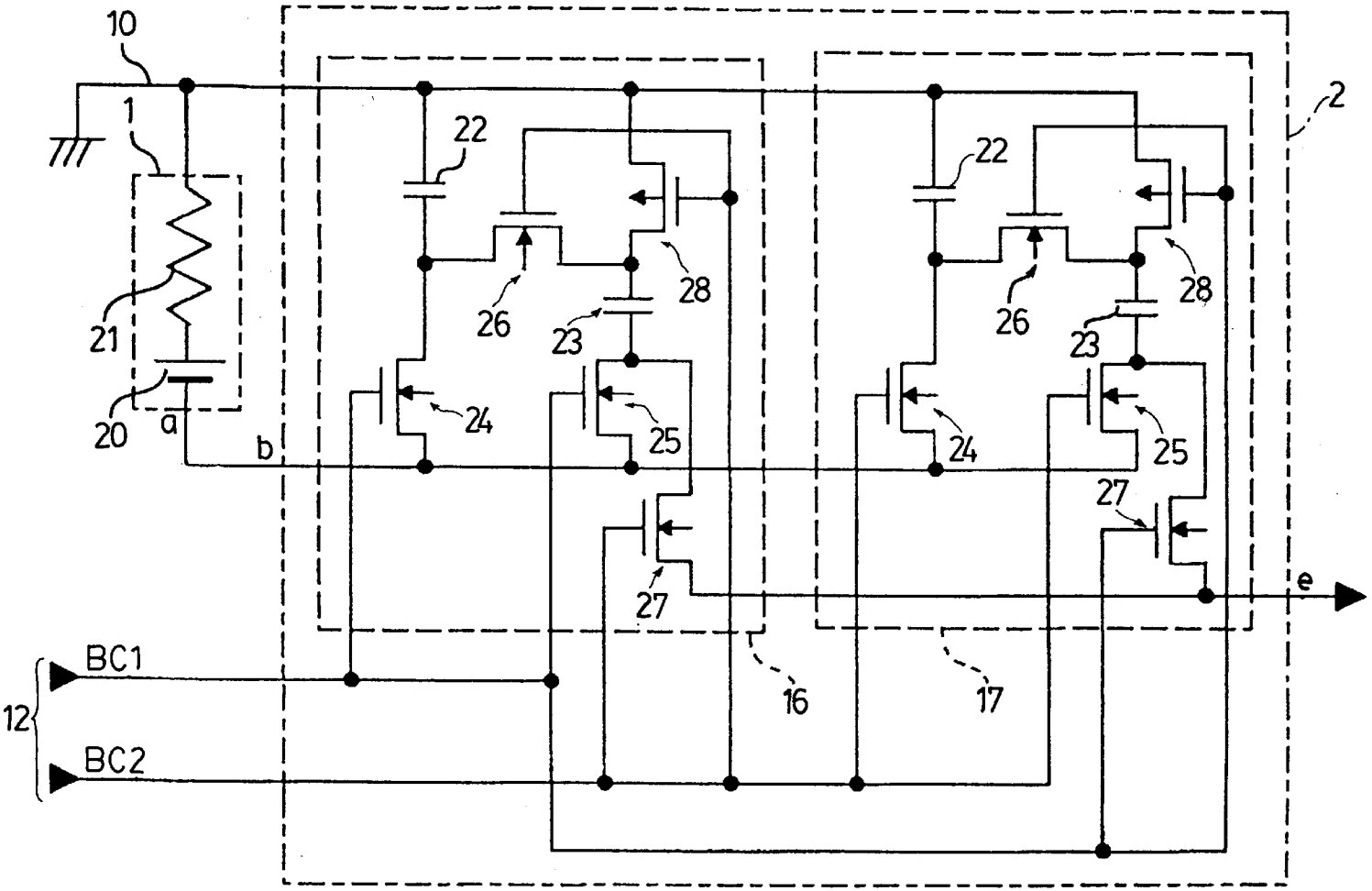
FIG. 2 is a circuit diagram showing an internal construction of an energy source 1 and a booster means 2 in FIG. 1.

Next, the circuit construction of the electronic watch relating to this embodiment will be described concretely for each block forming the watch. FIG. 2 is a circuit diagram showing an internal construction of the power supply 1 and the booster means 2 shown in FIG. 1.

The power supply 1 shown in FIG. 2 is an electrothermic generator in which multiple thermoelectric element pairs are assembled. The power supply 1 is equivalently illustrated by a voltage source 20 and an internal resistor 21.

The power supply 1 employs some thousands of thermoelectric element pairs to obtain an open voltage of about 1 to 2 volts necessary for starting the clock output means 4 shown in FIG. 1, and the resistance of the internal resistor 21 reaches some 10 kilo ohms or more.

The internal resistor 21 is shown to be connected to the high potential side of the voltage source 20, which is an equivalent representation, and it is generally conceived that the internal resistor 21 is uniformly distributed inside the voltage source 20.

The booster means 2 shown in FIG. 2 is comprised of a first booster circuit 16 and a second booster circuit 17.

The first booster circuit 16 and the second booster circuit 17 have an identical circuit construction. That is, both of them are comprised of a first capacitor 22 and a second capacitor 23, a first N-channel MOS transistor 24 (hereinafter, mentioned as N-MOST), a second N-MOST 25, a third N-MOST 26, a fourth N-MOST 27, and a P-channel MOS transistor 28 (hereinafter, mentioned as P-MOST).

Connections of components constructing the first booster circuit 16 and the second booster circuit 17 will be described.

The ground line 10 of the power supply 1 is connected to one terminal of the first capacitors 22 comprising the first booster circuit 16 and second booster circuit 17 and one terminals of the P-MOSTs 28. The power supply output terminal a of the power supply 1 is connected to one terminal of the first N-MOSTs 24 and one terminal of the second N-MOSTs 25 of the first booster circuit 16 and second booster circuit 17 via the power supply input terminal b of the booster means 2.

The other terminals of the first capacitors 22 comprising the first booster circuit 16 and second booster circuit 17 are connected to the other terminals of the first N-MOSTs 24 and one terminal of the third N-MOSTs 26. The other terminals of P-MOSTs 28 are connected to the other terminals of the third N-MOSTs 26 and one terminal of the second capacitors 23.

Furthermore, the other terminals of the second capacitors 23 are connected to the other terminals of the second N-MOSTs 25 and one terminal of the fourth N- MOSTs 27. The other terminals of the fourth N-MOSTs 27 are connected to the booster voltage output terminal e of the booster means 2.

Both of the gates of the first N-MOST 24 and the second N-MOST 25 constructing the first booster circuit 16 are connected to the three gates of the third N-MOST 26, the fourth N-MOST 27, and the P-MOST 28 which construct the second booster circuit 17. To all of these gates is applied a first booster control signal BC1 which enters the booster means 2 through the booster control signal bus 12 from the control means 7 shown in FIG. 1.

The gates of the third N-MOST 26 and fourth N-MOST 27 and P-MOST 28 constructing the second booster circuit 17 are connected to the gates of the first N-MOST 24 and second N-MOST 25 constructing the first booster circuit 16. A booster control signal BC2 which enters the booster means 2 via the booster control signal bus 12 from the control means 7 is applied to all of these gates.

Figure 3:
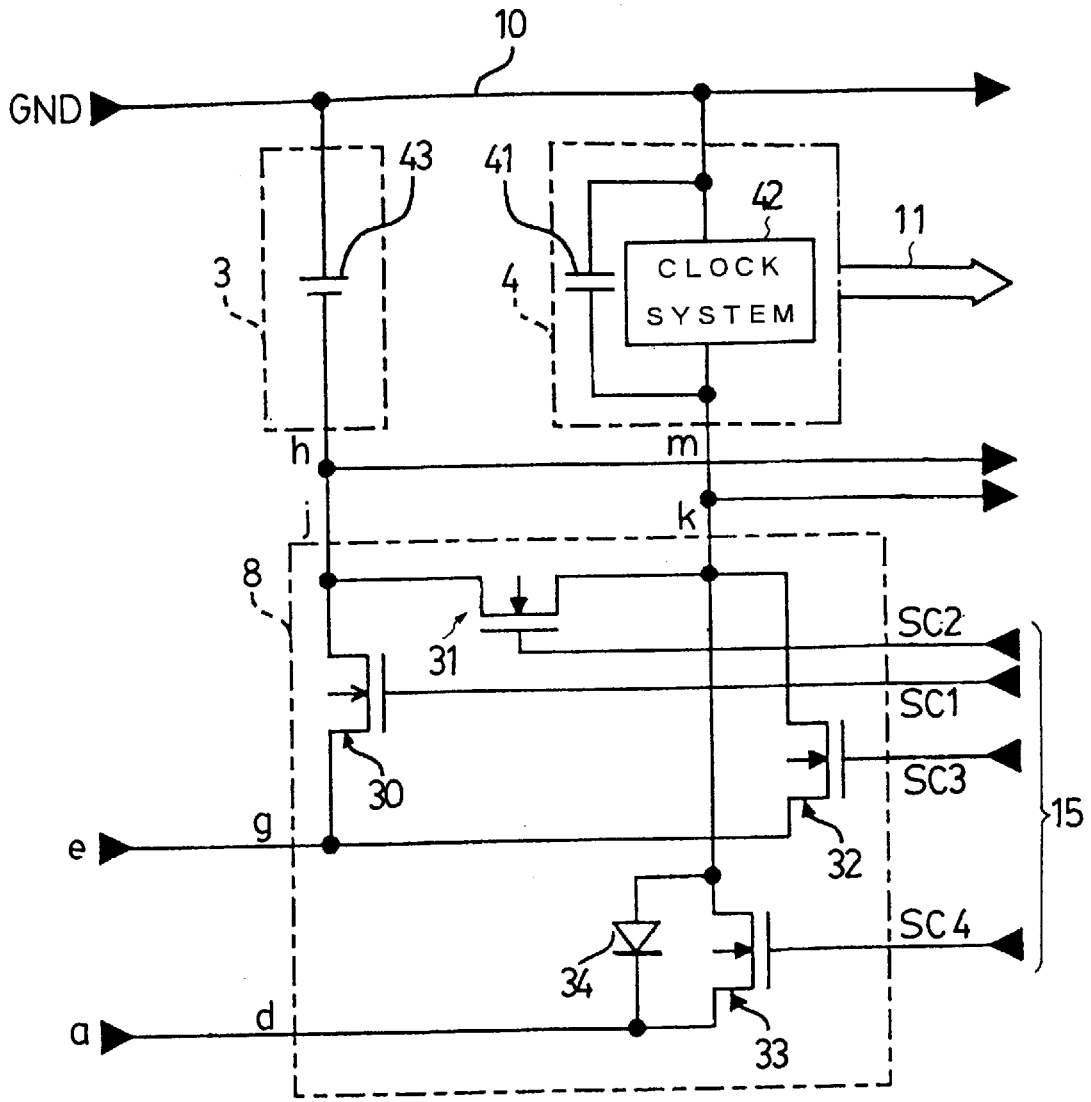
FIG. 3 is a circuit diagram showing an internal construction of a storage means 3, a watch output means 4, and a switch means 8 in FIG. 1.

FIG. 3 is a circuit diagram showing an internal construction of the storage means 3 and the clock output means 4 and the switching means 8 in FIG. 1.

The storage means 3 shown in FIG. 3 is a rechargeable secondary battery 43. The clock output means 4 is comprised of a clock system 42 and a condenser 41 with a small capacitance connected in parallel with the clock system 42 to stabilize the power supply of the clock system 42.

The high potential sides of the power supply terminals of the storage means 3 and the clock output means 4 are connected to the low potential sides of the power supply 1 via the ground line 10 shown in FIG. 1.

Although the internal construction of the clock system 42 is not illustrated, it is a system of a general crystal watch comprising a crystal oscillator, frequency divider, waveform generator, drive circuit, step motor, gear train, and display mechanism and the like.

The switching means 8 shown in FIG. 3 is comprised of a first to a fourth switch 30, 31, 32, 33 and a backflow preventer diode 34. Here, the switches are all N-MOSTs.

One terminal of the first switch 30 and one terminal of the third switch 32 are connected to make the booster voltage input terminal g, which is connected to the booster voltage output terminal e of the booster means 2 shown in FIG. 2. The other terminal of the first switch 30 and one terminal of the second switch 31 are connected to make the storage voltage input terminal j, which is connected to the storage voltage output terminal h, namely, the low potential side of the storage means 3.

One terminal of the fourth switch 33 and the cathode of the backflow preventer diode 34 are connected to make the power supply input terminal d, which is connected to the power supply output terminal a of the power supply 1 shown in FIG. 1.

The other terminal of the second switch 31 and the other terminal of the third switch 32 and the other terminal of the fourth switch 33 and the anode of the backflow preventer diode 34 are connected to make the voltage output terminal k, which is connected to the clock voltage terminal m of the clock output means 4.

A first, second, third, and fourth switch control signal SC1, SC2, SC3, and SC4 are individually applied to each of the gates of the first switch 30, the second switch 31, the third switch 32, and the fourth switch 33, respectively, through the switch control signal bus 15 from the control means 7 shown in FIG. 1.

Figure 7:
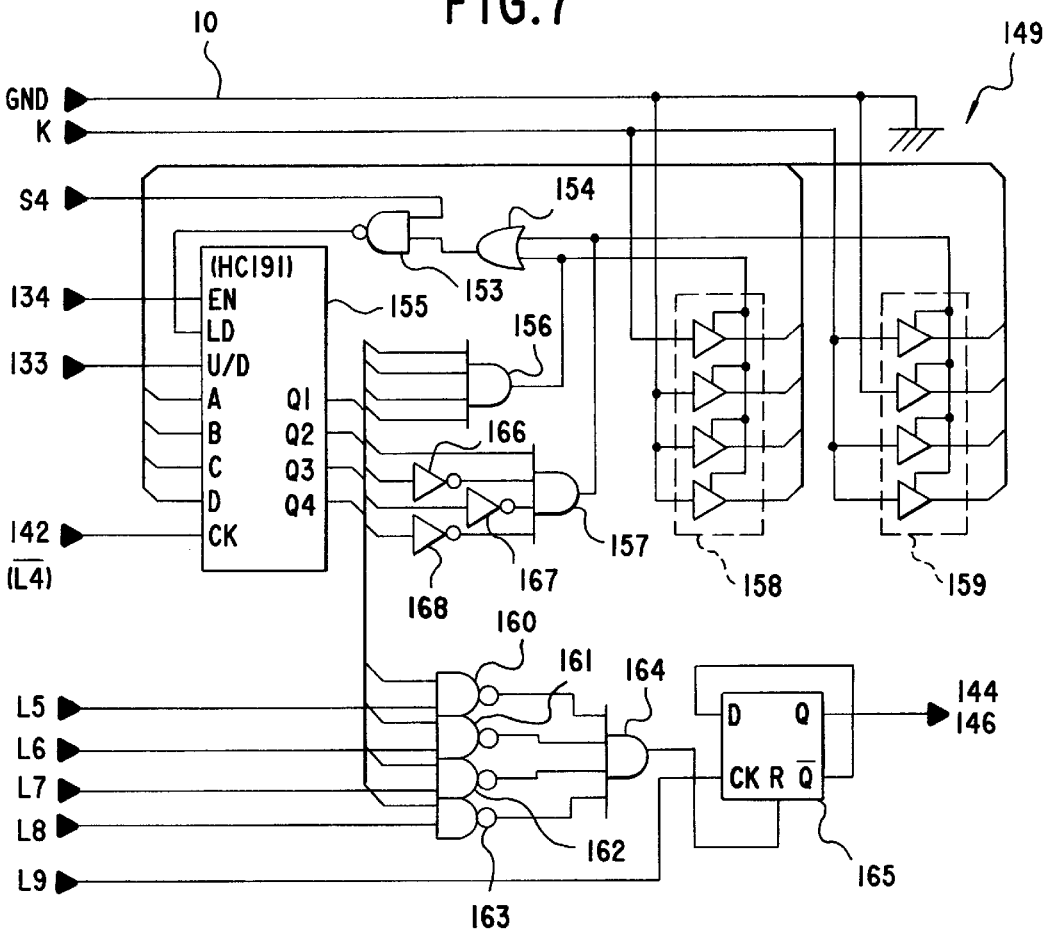
FIG. 7 is a circuit diagram showing a circuit construction of a pulse width control circuit 149 being a component of a switch control circuit 124 in FIG. 5.

The clock output means 4 gives logic signals to the control means 7 shown in FIG. 7 via the logic signal bus 11.

Figure 4:
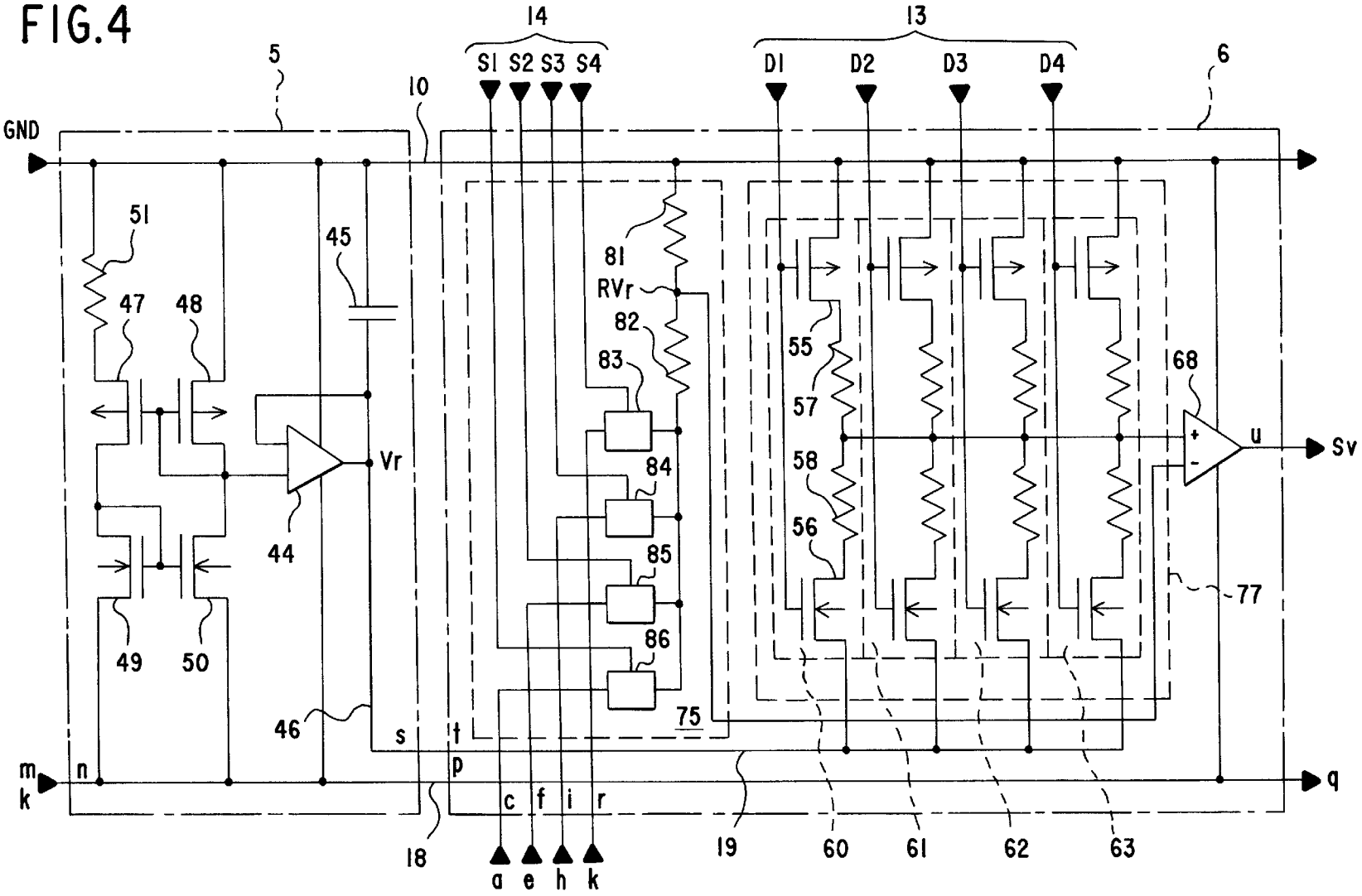
FIG. 4 is a circuit diagram showing an internal construction of a constant voltage circuit 5 and the voltage detection circuit 6 in FIG. 1.

FIG. 4 is a circuit diagram showing an internal construction of the constant voltage circuit 5 and the voltage detection circuit 6 in FIG. 1.

The constant voltage circuit 5 shown in FIG. 4 is a general constant voltage circuit, and it comprises N-MOSTs 49, 50 of an identical construction, P-MOSTs 47, 48 of an identical construction, a resistor 51, an operational amplifier 44, and a condenser 45.

One terminal of the P-MOST 47 is connected through the resistor 51 to the ground line 10 shown in FIGS. 1 and 2.

One terminal of the N-MOSTs 49, 50 is connected through the voltage input terminal n to a power supply line 18 for connecting the voltage output terminal k of the switching means 8 and the clock voltage terminal m of the clock output means 4 and the voltage input terminal p of the voltage detection circuit 6 and the like shown in FIG. 1.

The gates of the N-MOSTs 49, 50 are connected each other, and are also connected to the other terminals of the N-MOST 49 and the P-MOST 47. The other terminal of the N-MOST 50 is connected to the other terminal of the P-MOST 48 and the gates of the P-MOSTs 47, 48 are connected each other.

A reference voltage is generated at a point where the other terminals of the N-most 50 and the P-MOST 48 are connected each other. A voltage follower using the operational amplifier 44 transforms the reference voltage signal into a reference voltage signal Vr with a low signal source impedance. The reference voltage signal Vr is applied from the reference voltage output terminals to reference voltage line 19 of a D/A converter 77 via the reference voltage input terminal t of the voltage detection circuit 6.

The condenser 45 interposed between the output terminal of the operational amplifier 44 and the ground line 10 is to stabilize the reference voltage signal Vr.

On the other hand, the voltage detection circuit 6 shown in FIG. 4 comprises a voltage divider 75 and the D/A converter 77 and a comparator 68. The voltage divider 75 comprises a first and second resistor 81 and 82 having an identical resistance and a first to a fourth transmission gates 83, 84, 85, 86 (hereinafter, referred to as "TG").

One terminal of the first resistor 81 is connected to the ground line 10 and the other terminal is connected to one end of the second resistor 82. The other terminal of the second resistor 82 is connected to one input output terminal of the TGs 83, 84, 85, 86.

The other input output terminal of the first TG 83 is connected to the voltage output terminal k of the switch means 8 shown in FIG. 3. The other input output terminal of the second TG 84 is connected to the storage voltage output terminal h of the storage means shown in FIG. 3. The other input output terminal of the third TG 85 is connected to the booster voltage output terminal e of the booster means 2 shown in FIG. 2. The other input output terminal of the fourth TG 86 is connected to the power supply output terminal a of the power supply 1 shown in FIG. 2.

Selection signals of a first S1, second S2, third S3, and fourth S4 from the control means 7 each enter control terminals respectively of the fourth TG 86, third TG 85, second TG 84, and first TG 83, via the selection signal bus 14 shown in FIG. 1.

A comparison reference voltage signal RVr generated at a connection point of the first resistor 81 and the second resistor 82 enters an inversion input terminal of the comparator 68.

The D/A converter 77 comprises a first to fourth voltage dividing circuit 60, 61, 62, 63. One power supply terminal of the comparator 68 is connected to the ground line 10 and the other terminal is connected to the power supply line 18.

The voltage dividing circuits from 60 to 63 constructing the D/A converter 77 have an identical construction, each one of which is comprised of a series circuit of P-MOST 55, N-MOST 56, a resistor 57 and 58. Here, the resistance of the resistor 57 and 58 in one voltage dividing circuit is identical, which, however, is differentiated from the resistance in other voltage dividing circuits.

In this embodiment, the resistance of the resistors 57 and 58 is set to 1 MΩ in the first voltage dividing circuit 60, 2 MΩ in the second voltage dividing circuit 61, 4 MΩ in the third voltage dividing circuit 62, and 8 MΩ in the fourth voltage dividing circuit 63.

One terminal of the P-MOSTs 55 of the four voltage dividing circuits from 60 to 63 are connected to the ground line 10, and the other terminals are connected to one terminal of the resistors 57. The other terminals of the resistors 57 are connected to one terminal of the resistors 58, the other terminals of the resistors 58 are connected to one terminal of the N-MOSTs 56, and the other terminals of the N-MOSTs 56 are connected to the reference voltage line 19 where the reference voltage signal Vr is applied.

The connection points of the resistor 57 and 58 of the voltage dividing circuits from 60 to 63 are commonly connected to the noninversion input of the comparator 68.

The gates of the P-MOST 55 and the N-MOST 56 in the one voltage dividing circuit are connected each other, to each of the connected gates of the voltage dividing circuits from 60 to 63 are applied the first to fourth data signals D1, D2, D3, D4 from the control means 7 via the data signal bus 13 shown in FIG. 1.

A voltage detection signal Sv given by the comparator 68 goes through the voltage detection signal output terminal u to the voltage detection signal input terminal v of the control means 7 shown in FIG. 1.

Table 1 represents a relation between the input signal (data signals from D1 to D4) of the D/A converter 77 of the voltage detection circuit 6 and the output voltage (negative voltage) in this embodiment. The "ratio to the reference voltage" in this table represents a ratio between the potentials of the output voltages distributed to the noninversion input terminal of the comparator 68 corresponding to data of the four data signals D1, D2, D3, D4 and the potential of the reference voltage signal Vr.

Accordingly, the voltage of the noninversion input terminal of the comparator 68 distributed from the D/A converter 77 can take on 16 different output levels depending on data of the data signals from D1 to D4.

Figure 5:
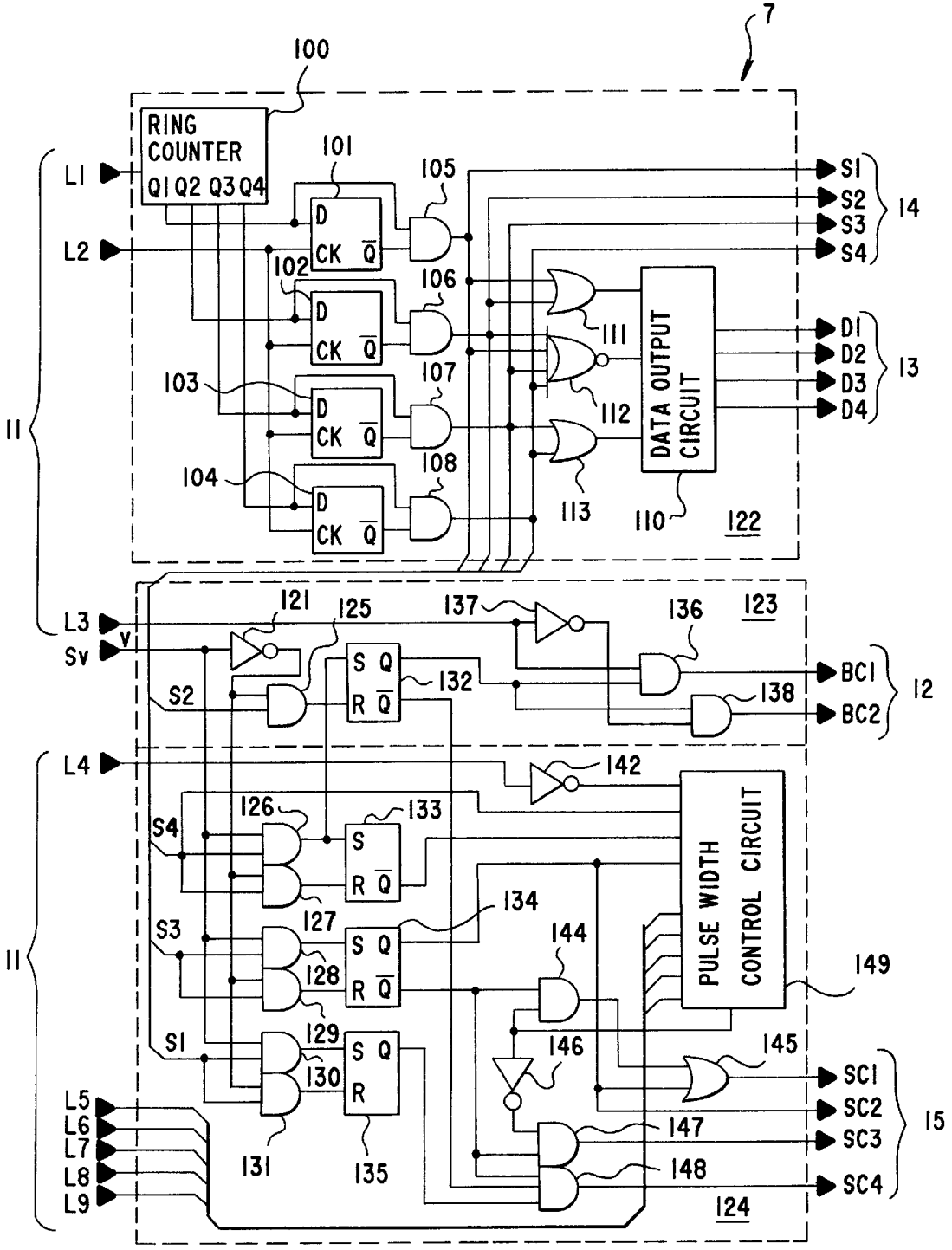
FIG. 5 is a circuit diagram showing an internal construction of a control means 7 in FIG. 1.

FIG. 5 is a circuit diagram showing an internal construction of the control means 7 shown in FIG. 1. The control means shown in FIG. 5 comprises a voltage detection control circuit 122, booster control circuit 123, and switch control circuit 124.

The voltage detection control circuit 122 comprises a ring counter 100, four data FFs (hereinafter, referred to as "DFF") from 101 to 104, four 2-input AND circuits from 105 to 108, two 2-input OR circuits 111, 113, a 4-input NOR circuit 112, and a data output circuit 110.

The booster control circuit 123 comprises two inverters 121, 137, three 2-input AND circuits 125, 136, 138, a set reset FF (hereinafter, referred to as SRFF) 132.

The switch control circuit 124 comprises two inverters 142 and 146, eight 2-input AND circuits from 126 to 131, 144 and 147, three SRFFs 133, 134, and 135, a 2-input OR circuit 145, a 3-input AND circuit 148, and a pulse width control circuit 149.

A clock input terminal of the ring counter 100 being a component of the voltage detection control circuit 122 receives a first logic signal L1 through the logic signal bus 11 from the clock output means 4 shown in FIG. 1.

An output Q1 of the ring counter 100 enters a data input terminal of the first DFF 101 and one input terminal of the first 2-input AND circuit 105, an output Q2 of the ring counter 100 enters a data input terminal of the second DFF 102 and one input terminal of the second 2-input AND circuit 106. In the same manner, an output Q3 of the ring counter 100 enters a data input terminal of the third DFF 103 and one input terminal of the third 2-input AND circuit 107, and an output Q4 of the ring counter 100 enters a data input terminal of the fourth DFF 104 and one input terminal of the fourth 2-input AND circuit 108.

Four clock input terminals of the four DFFs from 101 to 104 are connected one another, and receive a second logic signal L2 from the clock output means 4 shown in FIG. 1 through the logic signal bus 11.

An inverted output signal of the first DFF 101 enters the other input terminal of the first 2-input AND circuit 105, an inverted output signal of the second DFF 102 enters the other input terminal of the second 2-input AND circuit 106, an inverted output signal of the third DFF 103 enters the other input terminal of the third 2-input AND circuit 107, an inverted output signal of the fourth DFF 104 enters the other input terminal of the fourth 2-input AND circuit 108.

The first selection signal S1 from the output of the first 2-input AND circuit 105 enters one input terminal of the first 2-input OR circuit 111 and one input terminals of the 2-input AND circuit 130 and 131 being components of the switch control circuit 124.

The second selection signal S2 from the output of the second 2-input AND circuit 106 enters the other input terminal of the first 2-input OR circuit 111 and one input terminal of the 2-input AND circuit 125 being a component of the booster control circuit 123.

The third selection signal S3 from the output of the third 2-input AND circuit 107 enters one input terminal of the second 2-input OR circuit 113 and one input terminals of the 2-input AND circuit 128 and 129 being components of the switch control circuit 124.

The fourth selection signal S4 from the output of the fourth 2-input AND circuit 108 enters the other input terminal of the second 2-input OR circuit 113 and one input terminals of the 2-input AND circuit 126 and 127 being components of the switch control circuit 124.

Furthermore, each of these selection signals from S1 to S4 enters each of the input terminals of the 4-input NOR circuit 112, and an output signal from the 4-input NOR circuit 112 and output signals from the first and second 2-input OR circuits 111, 113 enter the data output circuit 110.

The data output circuit 110 distributes the foregoing four data signals D1, D2, D3, and D4.

The four selection signals from S1 to S4 and the four data signals from D1 to D4 enter the voltage detection circuit 6 shown in FIG. 4 through respectively the selection signal bus 14 and the data signal bus 13.

A third logic signal L3 enters the point where one input terminal of the 2-input AND circuit 136 of the booster control circuit 123 and an input terminal of the inverter 137 are connected, through the logic signal bus 11 from the clock output means 4 shown in FIG. 1. An output signal of the inverter 137 enters one input terminal of the 2-input AND circuit 138.

An input terminal of the inverter 121 of the booster control circuit 123 and the other three input terminals of the 2-input AND circuits 126, 128, 130 of the switch control circuit 124 are connected one another to make a voltage detection signal input terminal, into which the voltage detection signal Sv enters from the voltage detection circuit 6 shown in FIG. 4.

An output of the inverter 121 is connected to the other input terminal of the 2-input AND circuit 125 of the booster control circuit 123 and the other three input terminals of the 2-input AND circuits 127, 129, 131 of the switch control circuit 124.

An output signal of the 2-input AND circuit 125 enters a reset terminal of the SRFF 132, and a set terminal of the SRFF 132 is connected to an output terminal of the 2-input AND circuit 126 and a set terminal of the SRFF 133 that are components of the switch control circuit 124.

An output signal of the SRFF 132 enters the other input terminals of the 2-input AND circuits 136, 138, and an inverted output signal of the SRFF 132 enters the first input terminal of the 3-input AND circuit 148 of the switch control circuit 124.

Output signals of the 2-input AND circuits 136, 138 are respectively the first and second booster control signals BC1, BC2 which enter the booster means 2 through the booster control signal bus 12 shown in FIG. 1.

As described above, an output signal of the 2-input AND circuit 126 of the switch control circuit 124 enters the set terminal of the SRFF 133 and the set terminal of the SRFF 132 of the booster control circuit 123.

An output signal of the 2-input AND circuit 127 enters a reset terminal of the SRFF 133, an output signal of the 2-input AND circuit 128 enters a set terminal of the SRFF 134, and an output signal of the 2-input AND circuit 129 enters a reset terminal of the SRFF 134.

An output signal of the 2-input AND circuit 130 enters a set terminal of the SRFF 135 and an output signal of the 2-input AND circuit 131 enters a reset terminal of the SRFF 135.

An inverted output signal of the SRFF 133 enters an up-down terminal U/D of the pulse width control circuit 149. An output signal of the SRFF 134, namely, the first switch control signal SC1, enters the Enable terminal EN of the pulse width control circuit 149. A fourth logic signal L4 given by the clock output means 4 enters a clock terminal CK of the pulse width control circuit 149 through the inverter 142.

A fifth to ninth logic signal from L5 to L9 distributed from the clock output means 4 through the logic signal bus 11 each enter logic signal input terminals of the pulse width control circuit 149.

The output signal of the SRFF 134 being the first switch control signal SC1 also enters one terminal of the 2-input OR circuit 145.

An inverted output signal of the SRFF 134 enters the one terminals of the 2-input AND circuits 144, 147 and a second input terminal of the 3-input AND circuit 148. An output signal of the SRFF 135 enters a third input terminal of the 3-input AND circuit 148.

An output signal of the pulse width control circuit 149 enters the other input terminal of the 2-input AND circuit 144 and an input terminal of the inverter 146. An output signal of the inverter 146 enters the other input terminal of the 2-input AND circuit 147.

An output signal of the 2-input AND circuit 144 enters the other input terminal of the 2-input OR circuit 145. An output signal of the 2-input OR circuit 145 is the second switch control signal SC2. An output signal of the 2-input AND circuit 147 is the third switch control signal SC3, and an output signal of the 3-input AND circuit 148 is the fourth switch control signal SC4.

The first to fourth switch control signals SC1 to SC4 enter the switching means 8 through the switch control signal bus 15.

Figure 6:
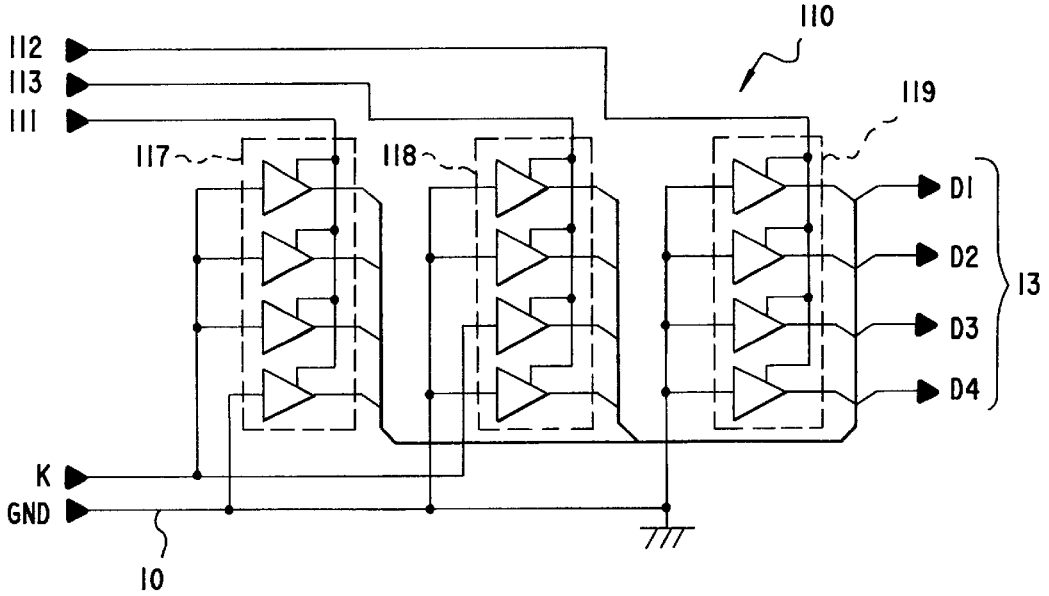
FIG. 6 is a circuit diagram showing a circuit construction of a data output circuit 110 being a component of a voltage detection control circuit 122 in FIG. 5.

FIG. 6 is a circuit diagram of the data output circuit 110 constructing the voltage detection control circuit 122, shown in FIG. 5, of the control means 7.

The data output circuit 110 comprises three tristate buffer blocks 117, 118, 119 each having 4-bit configurations.

An enable terminal of the first tristate buffer block 117 is connected to an output terminal of the first 2-input OR circuit 111 of the voltage detection control circuit 122 shown in FIG. 6. An enable terminal of the second tristate buffer block 118 is connected to an output terminal of the second 2-input OR circuit 113, and an enable terminal of the third tristate buffer block 119 is connected to an output terminal of the 4-input NOR circuit 112.

If enable signals enter the enable terminals of the tristate buffer blocks 117, 118, and 119, the first tristate buffer block 117 will give "8" in hexadecimal, the second tristate buffer block 118 will give "B" in hexadecimal, and the third tristate buffer block 119 will give "F" in hexadecimal, to the data signal bus 13 of the data signals from D1 to D4.

FIG. 7 is a circuit diagram of the pulse width control circuit 149 being a component of the switch control circuit 124 of the control means 7 shown in FIG. 5.

The pulse width control circuit comprises five 2-input NAND circuits 153, 160, 161, 162, and 163, three 4-input AND circuits 156, 157, 164, two tristate buffer blocks 158, 159 each having a 4-bit configuration, a DFF 165, a binary up-down counter 155 (hereinafter, simply referred to as "up-down counter") with a 4-bit configuration equivalent to a generally used IC 74HC191, and three inverters 166, 167, 168.

The enable terminal EN of the up-down counter 155 receives the output signal of the SRFF 134 of the switch control circuit 124 shown in FIG. 6, the up-down terminal U/D receives the inverted output signal of the SRFF 133, and the clock terminal receives an inverted signal of the fourth logic signal L4, namely, the output signal of the inverter 142.

One input terminal of the 2-input NAND circuit 153 receives the fourth selection signal S4. One terminal of the 2-input NAND circuits 160, 161, 162, and 163 respectively receive the fifth, sixth, seventh, eighth logic signals L5, L6, L7, and L8, that the clock output means 4 distributes through the logic signal bus 11. A clock input terminal of the DFF 165 receives the ninth logic signal L9.

Input terminals of the 4-input AND circuit 156 receive 4-bit output signals of the up-down counter 155. One input terminal of the 4-input AND circuit 157 directly receives the lower 1-bit (LSB) of the 4-bit output signal of the up-down counter 155, and the other three input terminals receive the upper 3-bits through the inverters 166, 167, 168.

The other input terminals of the four 2-input NAND circuits 160, 161, 162, 163 respectively receive output signals Q1, Q2, Q3, Q4 of the up-down counter 155.

An output signal of the 4-input AND circuit 156 enters one terminal of the 2-input OR circuit 154 and the enable terminal of the tristate buffer block 158.

An output signal of the 4-input AND circuit 157 enters the other terminal of the 2-input OR circuit 154 and the enable terminal of the tristate buffer block 159.

The output terminals of the tristate buffer block 158 and 159 coupled for each bit are each connected to the data input terminals A, B, C, D of the up-down counter 155.

An output signal of the 2-input OR circuit 154 enters the other input terminal of the 2-input NAND 153, whose output enters a load terminal LD of the up-down counter 155.

Output signals of the 2-input NAND circuits 160, 161, 162, and 163 enter the 4-input AND circuit 164, whose output enters a reset terminal R of the DFF 165.

An inverted output signal of the DFF 165 enters a data input terminal D, and a Q output signal enters the other input terminal of the 2-input AND circuit 144 and the input terminal of the inverter 146 being components of the switch control circuit 124 shown in FIG. 5.

When the tristate buffer blocks 158, 159 of the pulse width control circuit 149 receive the enable signals, the tristate buffer block 158 and 159 give respectively "E" and "2" in hexadecimal to the data input terminals of the up-down counter 155.

Next, the method of charging the electronic watch relating to this embodiment will be described.

When a temperature difference is given between the hot pole and the cold pole of the electrothermic generator of the power supply 1, a thermoelectromotive force, a potential between the poles, is generated. The generated voltage is supplied to the booster output means 2, the voltage detection circuit 6, and the switch means 8 from the power supply output terminal a.

The cathode of the backflow preventer diode 34 of the switching means 8 shown in FIG. 3 is connected to the power supply output terminal a; and when a voltage of about −1 to −2 volts is generated at this terminal a, the backflow preventer diode 34 is forward biased to let through a current, and the condenser 41 of the clock output means 4 is gradually charged.

The charged voltage is supplied to the watch system 42 as a power source for the watch, and is also supplied to the constant voltage circuit 5, the voltage detection circuit 6, and the control means 7 from the clock voltage terminal m via the power supply line 18.

However in this case, the voltage applied to the watch system 42 is lower by about 0.5 volts than the voltage generated by the power supply 1, due to the voltage drop by the forward bias of the backflow preventer diode.

If the voltage applied to the watch system 42 is lower than −0.7 volts, the watch system 42 of the clock output means 4, the constant voltage circuit 5, the voltage detection circuit 6, and the control means 7 will start operation.

The watch system 42 supplies the control means 7 with the logic signals from L1 to L9 through the logic signal bus 11. Thereby, the control means 7 supplies the booster control means 2 with the booster control signals BC1, BC2 through the booster signal bus 12, the voltage detection circuit 6 with the data signals from D1 to D4 and the selection signals from S1 to S4 through the data signal bus 13 and the selection signal bus 14, and the switch means with the switch control signals from SC1 to SC4 through the switch control signal bus 15.

When the watch system 42 starts operation, the logic signal bus 11 supplies the control means 7 with the first logic signal L1 of 4 Hz, the second logic signal L2 of a few tens of KHz to some KHz, the third logic signal L3 of 2 Hz, and the fourth logic signal L4 for driving the pointer for every second. Furthermore, the watch system 42 supplies the control means 7 with the fifth logic signal L5 of 8 Hz, the sixth logic signal L6 of 4 Hz, the seventh logic signal L7 of 2 Hz, the eighth logic signal L8 of 1 Hz, the ninth logic signal L9 that is made up by giving a delay to the eighth logic signal L8.

The constant voltage circuit 5 produces the reference voltage signal Vr of −0.7 volts, and supplies the reference voltage to the D/A converter 77 constructing the voltage detection circuit 6 shown in FIG. 4.

When the first and second logic signals L1, L2 enter the voltage detection control circuit 122 of the control means 7 shown in FIG. 5, the voltage detection control circuit 122 produces signals for every second as the selection signals from the first S1 to the fourth S4 such that pulses of one period of the second logic signal L2 are each shifted for each period of the first logic signal L1.

The first tristate buffer block 117 of the data output circuit 110 shown in FIG. 6 gives "8" in hexadecimal as the data signals from D1 to D4 to the data signal bus 13, when the first and second selection signals S1, S2 are "H".

In the same manner, the second tristate buffer block 118 gives "B" in hexadecimal as the data signals from D1 to D4, when the third and fourth selection signals S3, S4 are "H". The third tristate buffer block 119 gives "F" in hexadecimal as the data signals from D1 to D4, when any one of the selection signals from S1 to S4 are not "H".

Thus, in this embodiment, the data output circuit 110 gives the data of three states to the data signal bus 13.

The data signal bus 13 is connected to the gates of the P-MOSTs and N-MOSTs of the four voltage dividing circuits from 60 to 63 constructing the D/A converter 77 of the voltage detection circuit 6 shown in FIG. 4. Therefore, if the reference voltage signal Vr is −0.7 volts, the output voltage of the D/A converter 77, namely, the voltage of the noninversion input terminal of the comparator 68, as shown on the column of the output voltage in Table 1, becomes −0.374 volts, −0.514 volts, and −0.7 volts, when the data from the data signal bus 13 are "8", "B", and "F" in hexadecimal, respectively.

Furthermore, the first to fourth selection signal S1, S2, S3, S4 of the selection signal bus 14 enter the control terminals of the four TGs 86, 85, 84, 83, respectively, being components of the voltage divider 75 constructing the voltage detection circuit 6 shown in FIG. 4.

Therefore, the voltage detection circuit 6 selects the voltage generated by the power supply 1 when the first selection signal S1 is "H", the booster voltage of the booster means 2 when the second selection signal S2 is "H", the charged voltage of the storage means 3 when the third selection signal S3 is "H", and the clock voltage applied to the clock output means 4 when the fourth selection signal S4 is "H". The voltage thus selected is divided by the first resistor 81 and the second resistor 82 into half of the voltage, which is supplied to the inversion input terminal of the comparator 68 as the comparison reference voltage signal RVr.

In this manner, the voltage supplied to the inversion input terminal of the comparator 68 differs corresponding to the state of the selection signals from S1 to S4, and the voltage detection signal Sv of "L" or "H" depending on the state is supplied to the booster control circuit 123 and the switch control circuit 124 of the control means 7 shown in FIG. 5 from the voltage detection signal output terminal u, namely, the output terminal of the comparator 68.

Furthermore, the first selection signal S1, the third selection signal S3, and the fourth selection signal S4 enter the switch control circuit 124 of the control means 7 shown in FIG. 5, and the second selection signal S2 enters the booster control circuit 123.

Therefore, the booster control circuit 123 receives the voltage detection signal Sv, the second selection signal S2, and the third logic signal L3 to distribute the first booster control signal BC1 and the second booster signal BC2 to the booster means 2 through the booster control signal bus 12 as shown in FIG. 2.

The switch control circuit 124 shown in FIG. 5 receives the voltage detection signal Sv, the first, third, and fourth selection signals S1, S3, and S4, and the logic signals from fourth L4 to ninth L9 to distribute the first to fourth switch control signals SC1 to SC4 to the switch means 8 through the switch control signal bus 15 as shown in FIG. 3.

Figure 8:
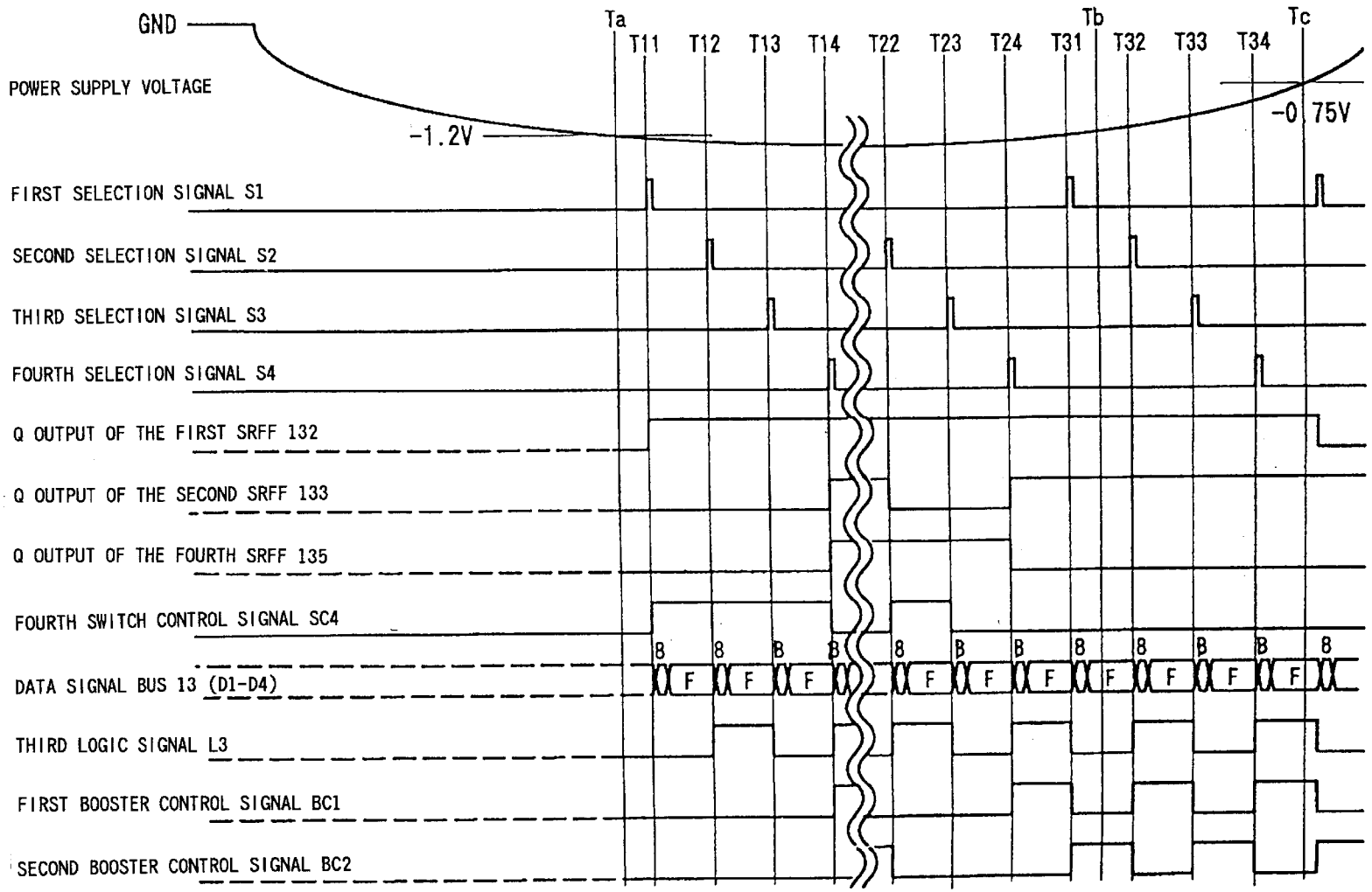
FIG. 8 illustrates waveforms when a voltage generated by the energy source 1 of the electronic watch shown in FIG. 1 increases and decreases.

FIG. 8 is a waveform chart of the signals when the voltage generated by the power supply 1 (energy source) of the electronic watch increases and decreases. This waveform chart shows the waveforms in the state that the secondary battery 43 of the storage means 3 is not charged.

The operation of the aforementioned electronic watch will be described with reference to the waveform chart. When the power supply voltage (electromotive voltage) generated by the power supply 1 becomes −1.2 volts or less (1.2 volts or more in absolute value) at time Ta, the clock output means 4, constant voltage circuit 5, voltage detection circuit 6, and control means 7 starts operation. At the moment of starting the operation, the inverted outputs of the four DFFs from 101 to 104 and the four SRFFs from 132 to 135 are "H", and the Q outputs of the four SRFFs from 132 to 135 are "L".

When the clock output means 4 starts operation, it gives the logic signals from L1 to L9 to the logic signal bus 11, and pulses in one period of the second logic signal L2 are distributed on the lines of the first to fourth selection signals from S1 to S4 for each second synchronously with the first logic signal L1.

First, if a pulse is supplied on the line of the first selection signal S1 at time T11, the fourth TG 86 of the voltage detection circuit 6 shown in FIG. 4 will be turned ON, and half of the power supply voltage that the power supply 1 supplies from the power supply output terminal a is given to the inversion input terminal of the comparator 68 as the comparison reference voltage RVr.

On the same timing as the above, the data output circuit 110 shown in FIG. 5 supplies the voltage detection circuit 6 shown in FIG. 4 with "8" in hexadecimal by means of the data signals from D1 to D4, through the data signal bus 13. Thereby, The P-MOSTs 55 of the first to third voltage dividing circuits 60, 61, 62 and the N-MOST 56 of the fourth voltage dividing circuit 63 are turned ON to supply the noninversion input terminal of the comparator 68 with −0.374 Volts.

As clearly seen in the foregoing description, the power supply voltage necessary for starting the clock output means 4 is −1.2 volts. Therefore, the comparison reference voltage signal, namely, half of the power supply voltage, is −0.6 volts and enters the inversion input terminal of the comparator 68, which, however, is lower than the voltage of the noninversion input terminal, −0.374 volts; and therefore, the voltage detection signal Sv goes "H".

The 2-input AND circuit 130 of the switch control circuit 124 shown in FIG. 5 receives the voltage detection signal Sv and the first selection signal S1 at its two inputs, and the output goes "H" synchronously with the pulse of the first selection signal S1 to turn the SRFF 135 into "set", thus turning the Q output into "H". At that moment, the inversion outputs of the SRFFs 132, 133, 134 are "H".

Since the inversion outputs of the SRFF 132 and 134 are "H", at the moment that the Q output of the SRFF 135 goes "H", the output of the 3-input AND circuit 148 receiving these three at its input, namely, the fourth switch control signal SC4 goes "H".

As the fourth switch control signal SC4 becomes "H", the fourth switch 33 of the switch means 8 shown in FIG. 3 goes ON; and accordingly, the voltage of the voltage output terminal k becomes the power supply voltage and the voltage of the clock voltage terminal m of the clock output means 4 also becomes the power supply voltage.

Since the inverted output of the SRFF 133 is "H" and the Q output of the SRFF 134 is "L", the pulse width control circuit 149 counts down and gives signals whose duties change for each second to the lines of the first switch control signal SC1 and the third switch control signal SC3, namely, the inverted signal of the first switch control signal SC1. The first and third switch control signals SC1, SC3 control the first and third switches 30, 32 of the switch means 8 shown in FIG. 3.

On the other hand, since the second switch control signal SC2 being the Q output signal of the SRFF 134 in FIG. 5 is "L", the second switch 31 shown in FIG. 3 is OFF.

At that moment, since the Q output of the SRFF 132 in FIG. 5 is "L", the first and second booster control signals BC1, BC2 being the output signals of the 2-input AND circuits 136, 138 are both "L". That is, the booster means 2 shown in FIG. 2 is not in operation yet.

Next, if a pulse is given to the line of the second selection signal S2 at time T12 in FIG. 8, the third TG85 of the voltage detection circuit 6 shown in FIG. 4 will go ON, half of the booster voltage given by the booster means 2 from the booster voltage output terminal e is supplied to the inversion input terminal of the comparator 68 as the comparison reference voltage signal RVr.

On the same timing as the above, the data output circuit 110 shown in FIG. 5 supplies the voltage detection circuit 6 shown in FIG. 4 with "8" in hexadecimal by means of the data signals from D1 to D4, through the data signal bus 13. Thereby, The P-MOSTs 55 of the first to third voltage dividing circuits 60, 61, 62 and the N-MOST 56 of the fourth voltage dividing circuit 63 are turned ON to supply the noninversion input terminal of the comparator 68 with −0.374 Volts, the same as in the aforementioned case.

However, the booster means 2 is not in operation yet at this stage, and the booster voltage is held virtually to the ground potential. Therefore, the voltage detection signal Sv being the output signal of the comparator 68 is "L". Accordingly, the output of the SRFF 132 shown in FIG. 5 is maintained to be "L", and the first and second booster control signals BC1, BC2 being the outputs of the 2-input AND circuits 136, 138 are "L"; and therefore, the booster means 2 shown in FIG. 2 is not in operation.

Since the outputs of the SRFFs 133, 134, 135 are unchanged at this stage, the switch control signals from SC1 to SC4 maintain the previous state.

Next, if a pulse is given to the line of the third selection signal S3 at time T13 in FIG. 8, the second TG84 of the voltage detection circuit 6 shown in FIG. 4 will go ON, half of the storage voltage given by the storage means 3 from the storage voltage output terminal h is supplied to the inversion input terminal of the comparator 68 as the comparison reference voltage signal RVr.

On the same timing as the above, the data output circuit 110 shown in FIG. 5 supplies the voltage detection circuit 6 shown in FIG. 4 with "B" in hexadecimal by means of the data signals from D1 to D4, through the data signal bus 13. Thereby, The P-MOST 55 of the third voltage dividing circuits 62 and the N-MOSTs 56 of the first, second, and fourth voltage dividing circuits 60, 61, and 63 are turned ON to supply the noninversion input terminal of the comparator 68 with −0.514 Volts.

However, the secondary battery 43 of the storage means 3 is not charged at this stage, and the storage voltage is held almost to the ground potential. Therefore, the voltage detection signal Sv being the output signal of the comparator 68 is "L". Accordingly, the SRFF 134 shown in FIG. 5 is maintained at reset, and the output is maintained to be "L".

Since the outputs of the SRFFs 132, 133, and 135 are unchanged at this stage, the switch control signals from SC1 to SC4 and the booster control signals BC1, BC2 maintain the previous state.

Next, if a pulse is given to the line of the fourth selection signal S4 at time T14 in FIG. 8, the first TG83 of the voltage detection circuit 6 shown in FIG. 4 will go ON, half of the clock voltage given by the switch means 8 from the storage voltage output terminal k is supplied to the inversion input terminal of the comparator 68 as the comparison reference voltage signal RVr.

On the same timing as the above, the data output circuit 110 shown in FIG. 5 supplies the voltage detection circuit 6 shown in FIG. 4 with "B" in hexadecimal by means of the data signals from D1 to D4, through the data signal bus 13.

Thereby, The P-MOST 55 of the third voltage dividing circuits 62 and the N-MOSTs 56 of the first, second, and fourth voltage dividing circuits are turned ON to supply the noninversion input terminal of the comparator 68 with −0.514 Volts.

Since the fourth switch 33 shown in FIG. 3 is ON at this stage, the clock voltage given by the switching means 8 is lower than −1.2 volts. Therefore, the comparison reference voltage signal of half of the clock voltage is lower than −0.6 volts, which is lower than the voltage of the noninversion input terminal, −0.514 volts; and therefore, the voltage detection signal Sv being the output signal of the comparator 68 goes "H".

Therefore, the output of the 2-input AND circuit 126 goes "H" synchronously with the pulse of the fourth selection signal S4 to put the SRFF 132 and 133 into set state; and therefore, the Q output of the SRFF 132 goes "H" and the inverted output of the SRFF 133 goes "L". The outputs of the SRFF 134 and 135 are not changed at this stage.

When the Q output of the SRFF 132 goes "H", the 2-input AND circuit 136 and 138 start operation. The first and second booster control signal BC1 and BC2 which are synchronous with the third logic signal L3 of 2 Hz in this embodiment are given to start the operation of the booster means 2 shown in FIG. 2.

When the inverted output of the SRFF 132 shown in FIG. 5 goes "L", synchronously with this, the fourth switch control signal SC4 goes "L" to bring the fourth switch 33 of the switching means 8 shown in FIG. 3 into OFF.

When the inverted output of the SRFF 133 in FIG. 5 goes "L", the pulse width control circuit 149 starts operation as an up-counter.

Although a pulse is supplied to the line of the first selection signal S1 at time T21, which is omitted in FIG. 8, the outputs of the SRFFs from 132 to 135 are not changed and continue the previous states.

Next, even if a pulse is supplied to the line of the second selection signal S2 at time T22 shown in FIG. 8, if the booster voltage has not yet increased to a sufficient level, the Q output of the SRFF 132 shown in FIG. 5 will go "L" to stop supplying the first and second booster control signals BC1, BC2.

The inverted output of the SRFF 132 goes "H" at this stage, and the fourth switch control signal SC4 goes "H" to put the fourth switch 33 in FIG. 3 into ON.

In the same manner, the operation at time T23 shown in FIG. 8 is the same as that at time T13, the operation at time T24 is the same as that at time T14, and the operation at time T31 is the same as that at time T21.

If the absolute value of the booster voltage is higher than 0.75 volts at time Tb between T31 and T32 and a pulse is supplied to the line of the second selection signal S2, the voltage of the comparison reference voltage signal RVr that the inversion input terminal of the comparator 68 shown in FIG. 4 receives will be lower than −0.375 volts. At that time the voltage of the noninversion input terminal is −0.374 volts. Therefore, the voltage detection signal Sv given by the comparator 68 goes "H".

Therefore, the SRFF 132 shown in FIG. 5 will not be reset, and the Q output maintains "H". And, since the inverted output of the SRFF 132 also maintains "L", the fourth switch control signal SC4 maintains "L" to bring the fourth switch 33 of the switch means 8 shown in FIG. 3 into OFF.

Next, if the absolute value of the power supply voltage given by the power supply 1 becomes lower than 0.75 volts at time Tc shown in FIG. 8, the Q output of the SRFF 135 will go "L" synchronously with the first selection signal S1 supplied at time T41 (not illustrated), which will bring the fourth switch control signal SC4 into "L".

If the absolute value of the storage voltage given by the storage means 3 becomes higher than 1.03 volts, which is not illustrated in FIG. 8, the Q output of the SRFF 134 shown in FIG. 5 will go "H" to stop the operation of the pulse width control circuit 149. Accordingly, the first and second switch control signals SC1, SC2 go "H", and the third and fourth switch control signals SC3, SC4 go "L".

Therefore, the first switch 30 and the second switch 31 shown in FIG. 3 go ON, the storage voltage output terminal h is connected to the clock voltage terminal m, and the third switch 32 and the fourth switch 33 go OFF.

Thus, the 3-input AND circuit 148 in FIG. 5 puts the fourth switch control signal SC4 into "L" and the fourth switch 33 shown in FIG. 3 into OFF, when the absolute value of the booster voltage is higher than 0.75 volts, the absolute value of the storage voltage is higher than 1.03 volts, or the absolute value of the power supply voltage is lower than 0.75 volts.

This is to prevent backflow of a current to the power supply 1 when the absolute value of the booster voltage or the storage voltage becomes larger than the absolute value of the power supply voltage.

Figure 9:
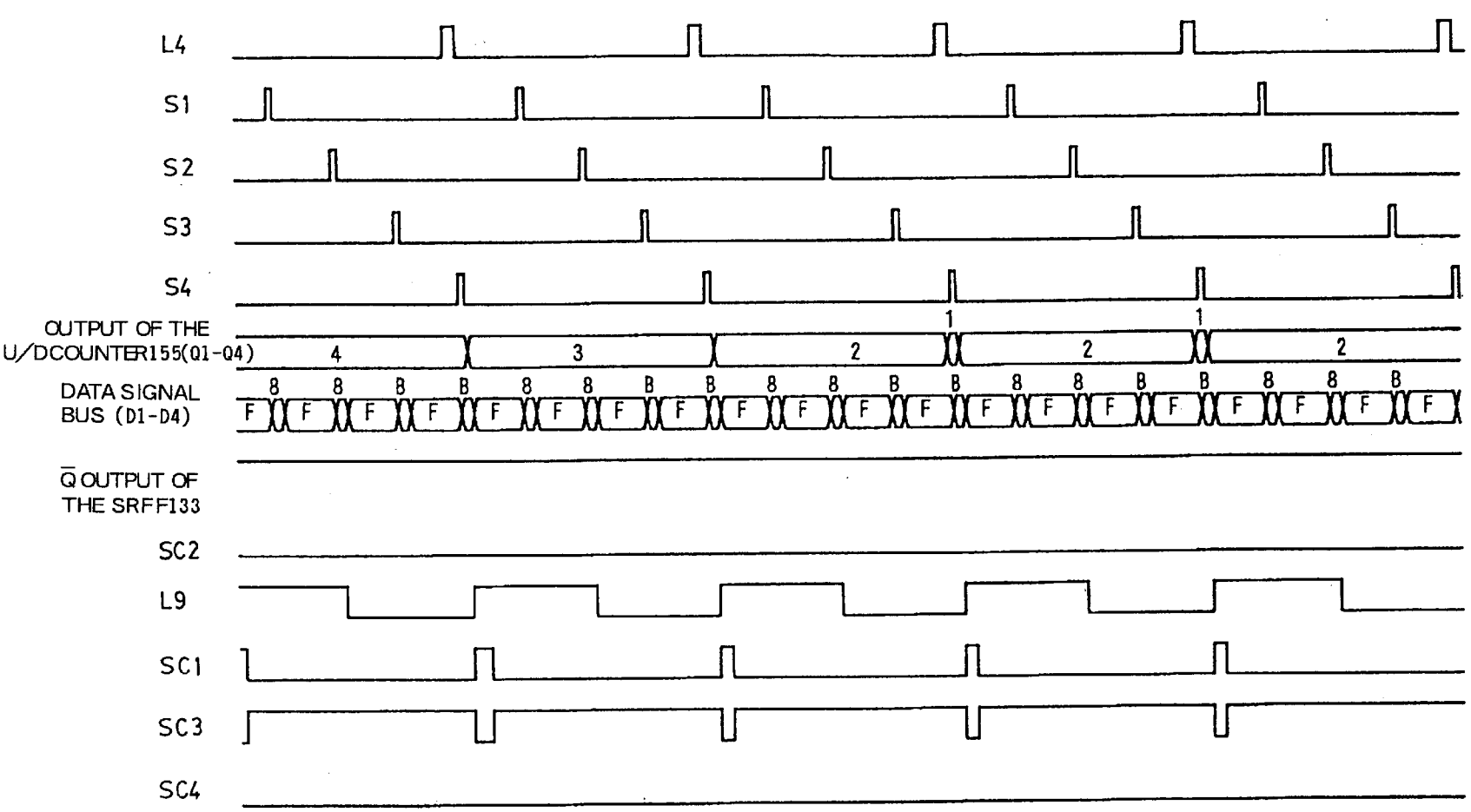
FIG. 9 is a waveform chart showing a state when the pulse width control circuit shown in FIG. 7 performs a count down.
Figure 10:
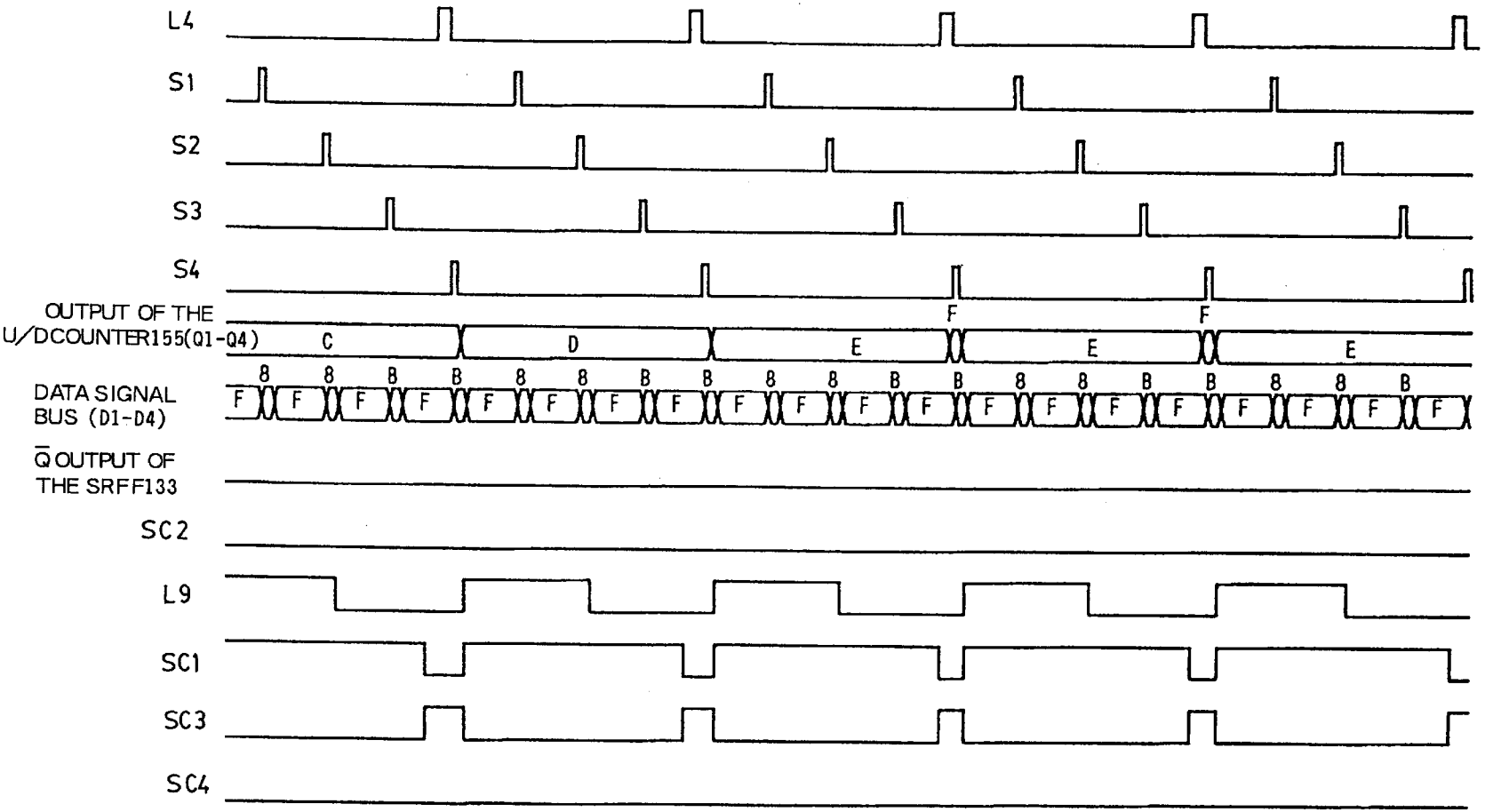
FIG. 10 is a waveform chart showing a state when the pulse width control circuit shown in FIG. 7 performs a count up.
Figure 11:
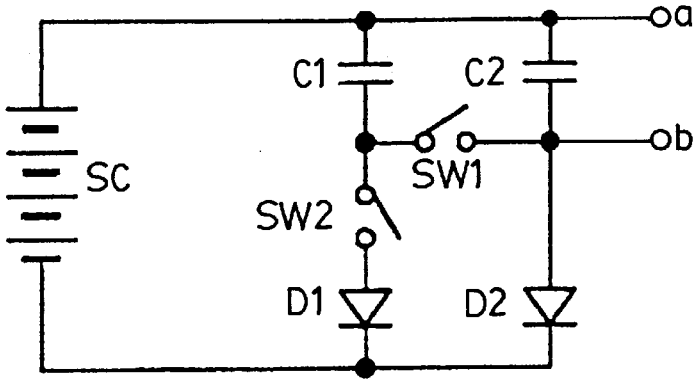
FIG. 11 PRIOR ART
FIGS. 11, 12, and 13 are circuit diagrams showing the initial condition of a charging circuit in a conventional electronic watch, a state when the voltage charged across a condenser C2 is 2 volts or more, and a state when the voltage charged across a condenser C1 is 2 volts or more.
Figure 12:
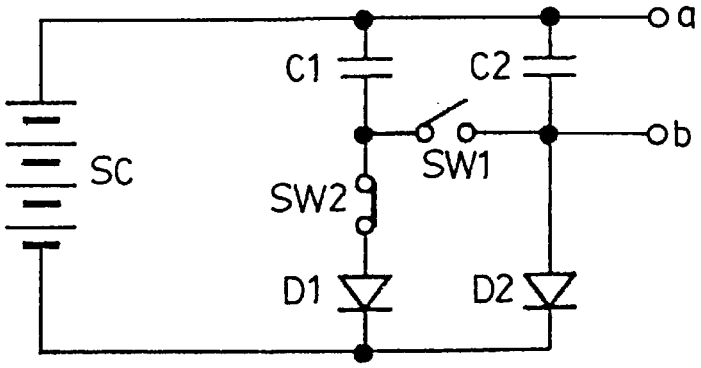
FIG. 12 PRIOR ART
Figure 13:
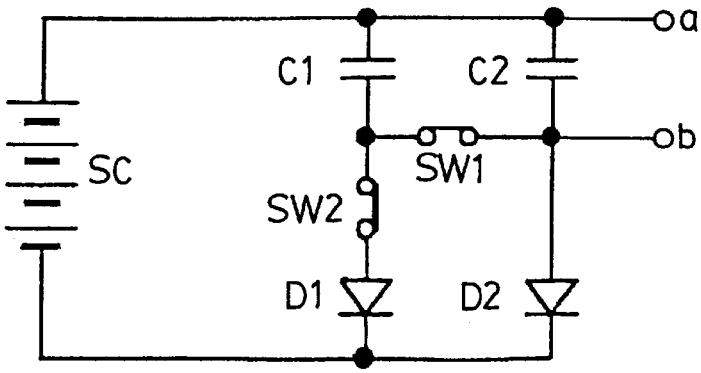
FIG. 13 PRIOR ART
Figure 14:
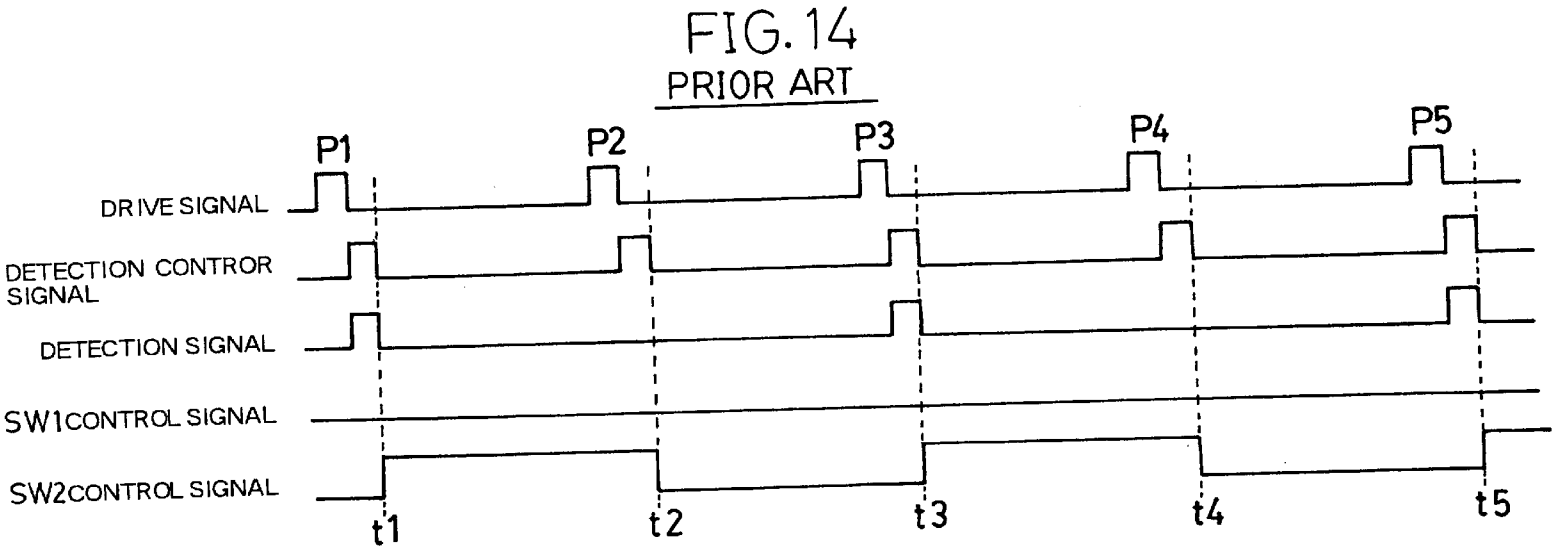
FIG. 14 PRIOR ART
FIGS. 14 and 15 are signal waveform charts for explaining the operation of the charging circuit of the electronic watch shown in FIGS. 11 to 13.
Figure 15:
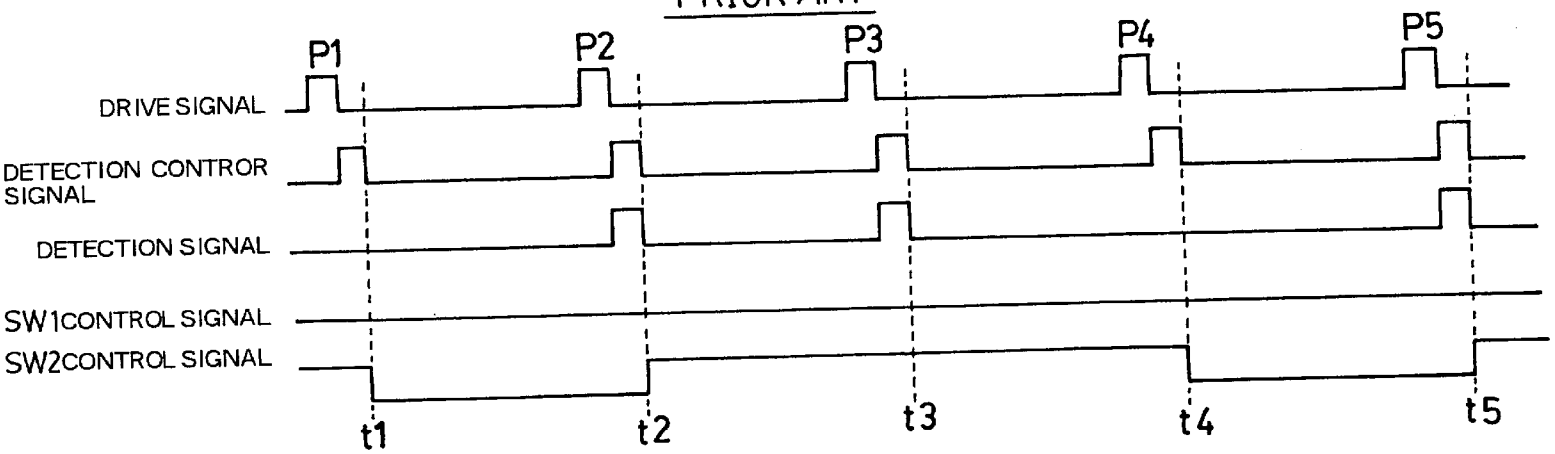
FIG. 15 PRIOR ART

FIG. 9 is a waveform chart showing a state that the pulse width control circuit 149 shown in FIG. 7 is counting down, and FIG. 10 is a waveform chart showing a state that the pulse width control circuit 149 is counting up.

Although not illustrated in FIGS. 9 and 10, the signal of 8 Hz for the fifth logic signal L5, the signal of 4 Hz for the sixth logic signal L6, the signal of 1 Hz for the seventh logic signal L7, and the signal of 1 Hz for the eighth logic signal L8 are the signals that rise synchronously with the rise of the fourth selection signal S4.

The fourth logic signal L4 synchronizes with the fourth selection signal S4, and gives pulses a little earlier than the fourth selection signal S4. The ninth logic signal L9 is the signal of 1 Hz produced after a pulse of the fourth selection signal S4 is given.

The down-counting operation of the pulse width control circuit 149 will be described with reference to the circuit shown in FIG. 7 and the down-counting waveforms shown in FIG. 9.

The outputs (from Q1 to Q4) of the up-down counter 155 shown in FIG. 7, first, are set to "4" in hexadecimal, and when the inverted signal of the fourth logic signal L4 enters the clock input terminal CK, the output signal of the up-down counter 155 becomes "3" in hexadecimal.

Next, when the inverted signal of the fourth logic signal L4 enters the clock input terminal CK, the output signal of the up-down counter 155 becomes "2" in hexadecimal.

Further next, when the inverted signal of the fourth logic signal L4 enters the clock input terminal CK, the output signal of the up-down counter 155 becomes "1" in hexadecimal.

When the output signal of the up-down counter 155 becomes "1" in hexadecimal, the second 4-input AND circuit 157 distribute an enable signal of "H" to the fifth tristate buffer block 159 and the fourth 2-input OR circuit 154.

Receiving the enable signal, the fifth tristate buffer block 159 gives "2" in hexadecimal to the data input terminals (from A to D) of the up-down counter 155. At the same time, the inverted signal of the fourth selection signal S4 is given to the load input terminal LD of the up-down counter 155.

When the inverted signal of the fourth selection signal S4 enters the load input terminal LD of the up-down counter 155, the up-down counter 155 gives "2" in hexadecimal to avoid overflow.

When the outputs of the up-down counter 155 are determined in this manner, the fifth DFF 165 turns the Q output thereof into "H" synchronously with the rise of the ninth logic signal L9. And, receiving the fifth logic signal L5 of the output value of the up-down counter 155, the fifth DFF 165 brings itself into reset and turns the Q output thereof into "L", thereby determining the duty of the charging time.

That is, FIG. 9 shows the waveforms at starting of the electronic watch of this invention. The condenser 41 connected in parallel to the clock output means 4 at this stage has a low voltage charged, and a detection output is not generated by the fourth selection signal S4, which is not illustrated. Here, the up-down counter 155 of the pulse width control circuit 149 operates as a down-counter so as to bring the clock output means 4 into a normal operation, which extends a period in which the third switch control signal SC3 is "H" in a step-form. Thereby, a period in which the third switch 32 connected to the condenser 41 is ON is prolonged in a step-form. Accompanying with this, a time for charging the condenser 41 is prolonged, on the contrary, a time for charging the secondary battery 43 is shortened in a step-form. The period in which the third switch 32 is ON by the third switch control signal SC3 is extended to a maximum length of time in which the up-down counter 155 is not overflowed, so that the condenser 41 can sufficiently be charged.

Next, the up-counting operation of the pulse width control circuit will be described with reference to the circuit shown in FIG. 7 and the up-counting waveforms shown in FIG. 10.

The outputs of the up-down counter 155 shown in FIG. 10, first, are set to "C" in hexadecimal, and when the inverted signal of the fourth logic signal L4 enters the clock input terminal CK, the output signal of the up-down counter 155 becomes "D" in hexadecimal.

Next, when the inverted signal of the fourth logic signal L4 enters the clock input terminal CK, the output signal of the up-down counter 155 becomes "E" in hexadecimal.

Further next, when the inverted signal of the fourth logic signal L4 enters the clock input terminal CK, the output signal of the up-down counter 155 becomes "F" in hexadecimal.

When the output signal of the up-down counter 155 becomes "F" in hexadecimal, the first 4-input AND circuit 156 distributes enable signal of "H" to the fourth tristate buffer block 158 and the fourth 2-input OR circuit 154.

Receiving the enable signal, the fourth tristate buffer block 158 gives "E" in hexadecimal to the data input terminals of the up-down counter 155. At the same time, the inverted signal of the fourth selection signal S4 is given to the load input terminal LD of the up-down counter 155.

When the inverted signal of the fourth selection signal S4 enters the load input terminal LD of the up-down counter 155, the up-down counter 155 gives "E" in hexadecimal to avoid overflow.

When the outputs of the up-down counter 155 are determined in this manner, the fifth DFF 165 turns the Q output thereof into "H" synchronously with the rise of the ninth logic signal L9. And, receiving the fifth logic signal L5 of the output value of the up-down counter 155, the fifth DFF 165 brings itself into reset and turns the Q output thereof into "L", thereby determining the duty of the charging time.

That is, FIG. 10 shows the waveforms at a normal operation of the electronic watch of this invention. The condenser 41 connected in parallel to the clock output means 4 at this stage has a sufficiently high voltage charged, and a detection output is generated by the fourth selection signal S4, which is not illustrated. Here, the up-down counter 155 of the pulse width control circuit 149 operates as a up-counter, which extends a period in which the first switch control signal SC1 is "H" in a step-form. Thereby, a period in which the first switch 30 connected to the secondary battery 43 is ON is prolonged in a step-form. On the contrary, a time for charging the condenser 41 is shortened in a step-form. The period in which the first switch 30 is ON by the first switch control signal SC1 is extended to a maximum length of time in which the up-down counter 155 is not overflowed, so that the secondary battery 43 can sufficiently be charged.

When the Q output of the fifth DFF 165 is determined as above, the line of the first switch control signal SC1 shown in FIG. 5 gives the same signal as the Q output signal of the fifth DFF 165 to the first switch 30 of the switch means 8 shown in FIG. 3, to turn the first switch 30 into ON, only when the signal is "H".

The line of the third switch control signal SC3 shown in FIG. 5 gives the inverted signal of the output signal of the fifth DFF 165 to the third switch 32 of the switching means 8 shown in FIG. 3, to turn the third switch 32 into ON, only when the signal is "H".

The minimum step to increase or decrease the charging time for charging the storage means 3 and the clock output means 4 in this embodiment is determined depending on the frequency of the fifth logic signal L5. The signal frequency of 8 Hz is applied in the foregoing example, and the minimum step is 62.5 msec.

The number of the steps in this case is 16 from 0 to F, which, however, is not confined to this. Using a higher frequency and more logic signals and increasing the bit number of the up-down counter 155 of the pulse width control circuit 149 realizes a still shorter step width and a higher step number.

Furthermore in the aforementioned embodiment, the voltage dividing circuits from 60 to 63 constructing the D/A converter 77 of the voltage detection circuit 6 shown in FIG. 4 are comprised of the P-MOSTs 55, N-MOSTs 56, and two kinds of the resistors 57, 58; however, designing the ratio of the channel width/channel length of the P-MOSTs 55 and N-MOSTs 56 so as to produce a desired on-resistance can omit the resistors 57 and 58.

Still in the aforementioned embodiment, employing a nonvolatile memory including MONOS, NMOS or flash ROM for the tristate buffer blocks 117, 118, 119 shown in FIG. 6 of the data output circuit 110 constructing the voltage detection control circuit 122 of the control means 7 and the tristate buffer blocks 158, 159 of the pulse width control circuit 149 shown in FIG. 7 constructing the switch control circuit 124 can provide an electronic watch capable of rewriting data according to specifications.

As described hereinabove, according to the electronic watch and the method of charging the same in the present invention, the energy generated by the power supply (energy source) can be charged efficiently into the storage means, since the control means generates pulse signals varying in a step-form and controls the charging time of the storage means and the clock output means corresponding to the output of the voltage detection circuit for detecting the voltage of the storage means and the clock output means.

Furthermore, employing the aforementioned control means can charge the clock output means in a second, and it is only needed to charge the stabilization capacitor supplying the clock voltage to the watch system at starting, with a power capable of driving the pulse motor for one pulse, and the capacitance of the stabilization capacitor can be reduced to less than half of the conventional one. Accordingly, the time constant for charging can be reduced, and the storage means can be charged quickly to the minimum operational voltage of the clock output means, even when there is virtually not any energy charged in the storage means, thereby enhancing the self-starting performance of the watch.

Still, as the foregoing embodiment, employing the D/A converter having four C-MOSTs connected in parallel in the voltage detection circuit can make 16 kinds of reference voltages from the constant voltage of the constant voltage circuit; and therefore, a single voltage comparator enables to detect in time division the voltage generated by the power supply, the booster output voltage of the booster means, and the storage voltage of the storage means and the like.

Still more, when there is a certain output in the power supply, short-circuiting the backflow preventer diode by the output signal of the clock output means prevents power loss by forward resistance of the backflow preventer diode, thus enhancing efficiency in use of the generated energy in the storage means and the clock output means.

While the specific embodiments of the present invention have been illustrated and described herein, it is realized that numerous modifications and changes will be apparent to those skilled in the art. It is therefore to be understood that the appended claims are intended to cover all such modifications and changes as fall within the true spirit and scope of the invention.

TABLE 1

| HEX | $D_1$ | $D_2$ | $D_3$ | $D_4$ | Ratio to the Reference Voltage | Output Voltage |
|---|---|---|---|---|---|---|
| 0 | 0 | 0 | 0 | 0 | 0 | 0 |
| 1 | 0 | 0 | 0 | 1 | 0.067 | 0.047 |
| 2 | 0 | 0 | 1 | 0 | 0.134 | 0.094 |
| 3 | 0 | 0 | 1 | 1 | 0.200 | 0.14 |
| 4 | 0 | 1 | 0 | 0 | 0.267 | 0.187 |
| 5 | 0 | 1 | 0 | 1 | 0.333 | 0.233 |
| 6 | 0 | 1 | 1 | 0 | 0.400 | 0.28 |
| 7 | 0 | 1 | 1 | 1 | 0.467 | 0.327 |
| 8 | 1 | 0 | 0 | 0 | 0.534 | 0.374 |
| 9 | 1 | 0 | 0 | 1 | 0.600 | 0.42 |
| A | 1 | 0 | 1 | 0 | 0.667 | 0.467 |
| B | 1 | 0 | 1 | 1 | 0.734 | 0.514 |
| C | 1 | 1 | 0 | 0 | 0.800 | 0.56 |
| D | 1 | 1 | 0 | 1 | 0.867 | 0.607 |
| E | 1 | 1 | 1 | 0 | 0.933 | 0.653 |
| F | 1 | 1 | 1 | 1 | 1.000 | 0.7 |

What is claimed is:

1. An electronic watch comprising:

an energy source that transforms an external energy into an electric energy and supplies a power supply voltage;

a booster circuit to generate a booster voltage from the power supply voltage;

a storage means for storing the power supply voltage or the booster voltage of the power supply voltage to supply a storage voltage;

a clock output means that has a watch system and a condenser of a small capacitance, that receives any of the power supply voltage or the booster voltage, and the storage voltage as a clock voltage, and supplies a plurality of logic signals;

a constant voltage circuit for generating a reference voltage from the clock voltage;

a voltage detection circuit that compares the power supply voltage or the booster voltage, the storage voltage, and the clock voltage selectively with a voltage set on the basis of the reference voltage and supplies a voltage detection signal;

a switching means provided with a plurality of switches, for controlling charging times of the storage means and the clock output means; and a control means for controlling the switching means corresponding to a plurality of the logic signals and the voltage detection signal so that the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

2. An electronic watch according to claim 1, wherein:

the control means has a voltage detection control circuit that supplies a plurality of selection signals and data signals for setting a voltage to the voltage detection circuit, and the voltage detection circuit comprises:

a voltage dividing circuit comprised of transmission gates for selecting any one of the power supply voltage or the booster voltage, the storage voltage, and the clock voltage corresponding to a plurality of the selection signals entering from the control means, and resistors for dividing the voltage selected thereby;

a D/A converter that converts the data signals (digital signals) entering from the control means into analog signals on the basis of the reference voltage from the constant voltage circuit and sets a voltage to be compared with a voltage selected by the voltage dividing circuit; and a comparator that compares the voltage set by the D/A converter with the voltage selected and divided by the voltage dividing circuit and supplies the voltage detection signal.

3. An electronic watch as claimed in claim 1, wherein:

the clock output means supplies a plurality of the logic signals, when the power supply voltage generated by the energy source becomes a specific level of voltage;

by means of the logic signals, the control means supplies a plurality of selection signals and data signals to the voltage detection circuit;

the voltage detection circuit selects any one of the power supply voltage, the booster voltage, the storage voltage, and the clock voltage corresponding to the selection signals, compares the selected voltage with a voltage set on the basis of the data signals and the reference voltage, and supplies the voltage detection signal corresponding to the magnitude of the voltages;

the control means supplies a plurality of switch control signals to the switching means corresponding to the voltage detection signal and the logic control signals;

by means of the switch control signals, the switching means switches a plurality of the switches ON/OFF to control the charging times of the storage means and the clock output means.

4. An electronic watch as claimed in claim 2, wherein:

the clock output means supplies a plurality of the logic signals, when the power supply voltage generated by the energy source becomes a specific level of voltage;

by means of the logic signals, the voltage detection control circuit of the control means supplies a plurality of the selection signals and the data signals to the voltage detection circuit;

the voltage dividing circuit selects any one of the power supply voltage or the booster voltage, the storage voltage, and the clock voltage by the transmission gates corresponding to the selection signals, and divides the voltage selected thereby;

the D/A converter converts the data signals into analog signals based on the reference voltage to set a voltage;

the comparator compares the selected and divided voltage with the set voltage, and supplies the voltage detection signal corresponding to the magnitude of the voltages;

the control means supplies a plurality of switch control signals to the switch means corresponding to the voltage detection signal and the logic control signals; and by means of the switch control signals, the switching means switches a plurality of the switches ON/OFF to control the charging times of the storage means and the clock output means.

5. An electronic watch, comprising:

an energy source that transforms an external energy into an electric energy and supplies a power supply voltage;

a booster circuit to generate a booster voltage from the power supply voltage;

a storage means for storing the power supply voltage or the booster voltage of the power supply voltage to supply a storage voltage;

a clock output means that has a watch system and a condenser of a small capacitance, that receives any of the power supply voltage or the booster voltage, and the storage voltage as a clock voltage, and supplies a plurality of logic signals;

a constant voltage circuit for generating a reference voltage from the clock voltage;

a voltage detection circuit that compares the power supply voltage or the booster voltage, the storage voltage, and the clock voltage selectively with a voltage set on the basis of the reference voltage and supplies a voltage detection signal;

a switching means provided with a plurality of switches, for controlling charging times of the storage means and the clock output means; and a control means for controlling the switching means corresponding to a plurality of the logic signals and the voltage detection signal, wherein the control means is provided with a switch control circuit that has a pulse width control circuit, and supplies a plurality of pulse width variable switch control signals to the switching means for controlling the charging times of the storage means and the clock output means by receiving the logic signals from the clock output means and the voltage detection signal from the voltage detection circuit.

6. An electronic watch according to claim 5, wherein the switch control circuit of the control means supplies, as a plurality of the switch control signals, a first, a second, a third, and a fourth switch control signal to the switch means, wherein the switching means comprises:

a first switch connected between a terminal of the booster voltage and a terminal of the storage voltage, controlled to be ON/OFF by the first switch control signal;

a second switch connected between a terminal of the storage voltage and a terminal of the clock voltage, controlled to be ON/OFF by the second switch control signal;

a third switch connected between a terminal of the booster voltage and a terminal of the clock voltage, controlled to be ON/OFF by the third switch control signal;

a fourth switch connected between a terminal of the power supply voltage and a terminal of the clock voltage, controlled to be ON/OFF by the fourth switch control signal; and a diode for preventing a backflow, connected in parallel with the fourth switch.

7. An electronic watch as claimed in claim 5, wherein:

the clock output means supplies a plurality of the logic signals, when the power supply voltage generated by the energy source becomes a specific level of voltage; by means of the logic signals, the voltage detection control circuit of the control means supplies a plurality of the selection signals and the data signals to the voltage detection circuit;

the voltage detection circuit selects any one of the power supply voltage or the booster voltage, the storage voltage, and the clock voltage corresponding to the selection signals, and compares the selected voltage with a voltage set on the basis of the data signal and the reference voltage, and supplies the voltage detection signal corresponding to the magnitude of the voltages;

the control means supplies a plurality of pulse width variable switch control signals from the switch control circuit, corresponding to the voltage detection signal and the logic control signals; and by means of a plurality of the switch control signals, the switching means controls the charging times of the storage means and the clock output means so that the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

8. An electronic watch as claimed in claim 6, wherein:

the clock output means supplies a plurality of the logic signals, when the power supply voltage generated by the energy source becomes a specific level of voltage;

by means of the logic signals, the voltage detection control circuit of the control means supplies a plurality of the selection signals and the data signals to the voltage detection circuit;

the voltage detection circuit selects any one of the power supply voltage or the booster voltage, the storage voltage, and the clock voltage corresponding to the selection signals, and compares the selected voltage with a voltage set on the basis of the data signal and the reference voltage, and supplies the voltage detection signal corresponding to the magnitude of the voltages;

the control means supplies the first, the second, the third, and the fourth switch control signal for controlling the switching means from the switch control circuit corresponding to the voltage detection signal and the logic signals; and by means of the first, the second, the third, and the fourth switch control signal, the switching means switches the first, the second, the third, and the fourth switch ON/OFF to control the charging times of the storage means and the clock output means so that the charging time of the condenser of the clock output means becomes longer than the charging time of the storage means at a starting time of the clock system and the charging time of the storage means becomes longer than the charging time of the condenser of the clock output means at a normal operation of the clock system, and the diode for preventing a backflow is in connection between the terminal of the power supply voltage and the terminal of the clock voltage when the fourth switch is turned OFF.

9. An electronic watch as claimed in claim 8, wherein, when the switch control circuit of the control means determines from the voltage detection signal and the logic signals that the storage voltage is lower than a preset level, the fourth switch control signal turns ON the fourth switch of the switch means to short-circuit the diode for preventing the backflow.

10. An electronic watch as claimed in claim 8, wherein, when the switch control circuit of the control means determines from the voltage detection signal and the logic signals that the storage voltage is higher than the preset level, the second switch control signal turns ON the second switch of the switch means and the fourth switch control signal turns OFF the fourth switch of the switch means.

11. An electronic watch comprising:

an energy source that transforms an external energy into an electric energy and supplies a power supply voltage;

a storage means for storing the power supply voltage to supply a storage voltage;

a clock output means that has a watch system and a condenser of a small capacitance, that receives the power supply voltage or the storage voltage as a clock voltage, and supplies a plurality of logic signals;

a constant voltage circuit for generating a reference voltage from the clock voltage;

a voltage detection circuit that compares the power supply voltage or the storage voltage, and the clock voltage selectively with a voltage set on the basis of the reference voltage and supplies a voltage detection signal;

a switching means provided with a plurality of switches, for controlling charging times of the storage means and the clock output means; and a control means for controlling the switching means corresponding to a plurality of the logic signals and the voltage detection signal so that the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

12. An electronic watch as claimed in claim 11, wherein:

the clock output means supplies a plurality of the logic signals, when the power supply voltage generated by the energy source becomes a specific level of voltage;

by means of the logic signals, the control means supplies a plurality of selection signals and data signals to the voltage detection circuit;

the voltage detection circuit selects any one of the power supply voltage, the storage voltage, and the clock voltage corresponding to the selection signals, compares the selected voltage with a voltage set on the basis of the data signals and the reference voltage, and supplies the voltage detection signal corresponding to the magnitude of the voltages;

the control means supplies a plurality of switch control signals to the switching means corresponding to the voltage detection signal and the logic control signals;

by means of the switch control signals, the switching means switches a plurality of the switches ON/OFF to control the charging times of the storage means and the clock output means.

13. An electronic watch according to claim 11, wherein:

the control means has a voltage detection control circuit that supplies a plurality of selection signals and data signals for setting a voltage to the voltage detection circuit, and the voltage detection circuit comprises:

a voltage dividing circuit comprised of a transmission gates for selecting any one of the power supply voltage or the storage voltage, and the clock voltage corresponding to a plurality of the selection signals entering from the control means, and resistors for dividing the voltage selected thereby;

a D/A converter that converts the data signals (digital signals) entering from the control means into analog signals on the basis of the reference voltage from the constant voltage circuit and sets a voltage to be compared with a voltage selected by the voltage dividing circuit; and a comparator that compares the voltage set by the D/A converter with the voltage selected and divided by the voltage dividing circuit and supplies the voltage detection signal.

14. An electronic watch as claimed in claim 13, wherein:

the clock output means supplies a plurality of the logic signals, when the power supply voltage generated by the energy source becomes a specific level of voltage;

by means of the logic signals, the voltage detection control circuit of the control means supplies a plurality of the selection signals and the data signals to the voltage detection circuit; wherein:

the voltage dividing circuit selects any one of the power supply voltage or the storage voltage, and the clock voltage by the transmission gates corresponding to the selection signals, and divides the voltage selected thereby;

the D/A converter converts the data signals into analog signals based on the reference voltage to set a voltage;

the comparator compares the selected and divided voltage with the set voltage, and supplies the voltage detection signal corresponding to the magnitude of the voltages;

the control means supplies a plurality of switch control signals to the switch means corresponding to the voltage detection signal and the logic control signals; and by means of the switch control signals, the switching means switches a plurality of the switches ON/OFF to control the charging times of the storage means and the clock output means.

15. An electronic watch, comprising:

an energy source that transforms an external energy into an electric energy and supplies a power supply voltage;

a storage means for storing the power supply voltage supply voltage to supply a storage voltage;

a clock output means that has a watch system and a condenser of a small capacitance, that receives the power supply voltage or the storage voltage as a clock voltage, and supplies a plurality of logic signals;

a constant voltage circuit for generating a reference voltage from the clock voltage;

a voltage detection circuit that compares the power supply voltage or the storage voltage, and the clock voltage selectively with a voltage set on the basis of the reference voltage and supplies a voltage detection signal;

a switching means provided with a plurality of switches, for controlling charging times of the storage means and the clock output means; and a control means for controlling the switching means corresponding to a plurality of the logic signals and the voltage detection signal, wherein the control means is provided with a switch control circuit that has a pulse width control circuit, and supplies a plurality of pulse width variable switch control signals to the switching means for controlling the charging times of the storage means and the clock output means by receiving the logic signals from the clock output means and the voltage detection signal from the voltage detection circuit.

16. An electronic watch according to claim 15, wherein the switch control circuit of the control means supplies, as a plurality of the switch control signals, a first and a second switch control signal to the switch means, wherein the switching means comprises:

a first switch connected between a terminal of the storage voltage and a terminal of the clock voltage, controlled to be ON/OFF by the first switch control signal;

a second switch connected between a terminal of the power supply voltage and a terminal of the clock voltage, controlled to be ON/OFF by the second switch control signal; and a diode for preventing a backflow, connected in parallel with the second switch.

17. An electronic watch as claimed in claim 15, wherein:

the clock output means supplies a plurality of the logic signals, when the power supply voltage generated by the energy source becomes a specific level of voltage;

by means of the logic signals, the voltage detection control circuit of the control means supplies a plurality of the selection signals and the data signals to the voltage detection circuit;

the voltage detection circuit selects any one of the power supply voltage or the storage voltage, and the clock voltage corresponding to the selection signals, and compares the selected voltage with a voltage set on the basis of the data signal and the reference voltage, and supplies the voltage detection signal corresponding to the magnitude of the voltages;

the control means supplies a plurality of pulse width variable switch control signals from the switch control circuit, corresponding to the voltage detecting signal and the logic control signals; and by means of plurality of the switch control signals, the switching means controls the charging times of the storage means and the clock output means so that the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

18. An electronic watch as claimed in claim 16, wherein:

the clock output means supplies a plurality of the logic signals, when the power supply voltage generated by the energy source becomes a specific level of voltage;

by means of the logic signals, the voltage detection control circuit of the control means supplies a plurality of the selection signals and the data signals to the voltage detection circuit;

the voltage detection circuit selects any one of the power supply voltage or the storage voltage, and the clock voltage corresponding to the selection signals, and compares the selected voltage with a voltage set on the basis of the data signal and the reference voltage, and supplies the voltage detection signal corresponding to the magnitude of the voltages;

the control means supplies the first and the second switch control signal for controlling the switching means from the switch control circuit corresponding to the voltage detection signal and the logic signals; and by means of the first and the second switch control signals, the switching means switches the first and the second switch ON/OFF to control the charging times of the storage means and the clock output means so that the charging time of the condenser of the clock output means becomes longer than the charging time of the storage means at a starting time of the clock system and the charging time of the storage means becomes longer than the charging time of the condenser of the clock output means at a normal operation of the clock system, and the diode for preventing a backflow is in connection between the terminal of the power supply voltage and the terminal of the clock voltage when the second switch is turned OFF.

19. An electronic watch as claimed in claim 18, wherein, when the switch control circuit of the control means determines from the voltage detection signal and the logic signals that the storage voltage is higher than the present level, the first switch control signal turns ON the first switch of the switch means and the second switch control signal turns OFF the second switch of the switch means.

20. An electronic watch as claimed in claim 18, wherein, when the switch control circuit of the control means determines from the voltage detection signal and the logic signals that the storage voltage is lower than a present level, the second switch control signal turns ON the second switch of the switch means to short-circuit the diode for preventing the backflow.

21. A method of charging an electronic watch, comprising the steps of:

transforming an external energy into an electric energy supplying a power supply voltage;

boosting the power supply voltage to supply a booster voltage;

storing the power supply voltage or the booster voltage in a storage means to supply a storage voltage;

providing a clock voltage to a clock output means, having a watch system and a condenser of a small capacitance, from at least one of the power supply voltage, the booster voltage, and the storage voltage;

generating a plurality of logic signals from the clock output means;

supplying a reference voltage from the clock voltage;

comparing at least one of the power supply voltage, the booster voltage, and the storage voltage with a voltage set on the basis of the reference voltage to generate a voltage detection signal corresponding to the magnitude of the voltages;

controlling charging times of the storage means and the clock output means based on switches controlled by the logic signals and the voltage detection signal, so that the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

22. A method of charging an electronic watch, comprising the steps of:

transforming an external energy into an electric energy supplying a power supply voltage;

storing the power supply voltage in a storage means to supply a storage voltage;

providing a clock voltage to a clock output means, having a watch system and a condenser of a small capacitance, from the power supply voltage or the storage voltage;

generating a plurality of logic signals from the clock output means;

supplying a reference voltage from the clock voltage;

comparing the power supply voltage or the storage voltage with a voltage set on the basis of the reference voltage to generate a voltage detection signal corresponding to the magnitude of the voltages;

controlling charging times of the storage means and the clock output means based on switches controlled by the logic signals and the voltage detection signal, so that the charging time of the condenser of the clock output means becomes longer stepwise and the charging time of the storage means becomes shorter stepwise at a starting time of the clock system, and the charging time of the condenser of the clock output means becomes shorter stepwise and the charging time of the storage means becomes longer stepwise at a normal operation of the clock system.

* * * * *